US006609790B2

(12) United States Patent
Kurata et al.

(10) Patent No.: US 6,609,790 B2
(45) Date of Patent: Aug. 26, 2003

(54) INK JET APPARATUS AND INK JET CARTRIDGE AND INK CONTAINER MOUNTABLE THERETO

(75) Inventors: Mitsuru Kurata, Kawasaki (JP); Tokihide Ebata, Kawasaki (JP); Noribumi Koitabashi, Yokohama (JP); Hiromitsu Hirabayashi, Yokohama (JP); Hitoshi Sugimoto, Yokohama (JP); Haruo Uchida, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/123,260

(22) Filed: Apr. 17, 2002

(65) Prior Publication Data

US 2002/0149655 A1 Oct. 17, 2002

Related U.S. Application Data

(62) Division of application No. 09/547,341, filed on Apr. 11, 2000, which is a division of application No. 08/861,768, filed on May 22, 1997, now Pat. No. 6,086,192, which is a continuation of application No. 08/627,366, filed on Apr. 4, 1996, now Pat. No. 5,693,901, which is a continuation of application No. 08/323,050, filed on Oct. 14, 1994, now abandoned, which is a continuation of application No. 07/993,919, filed on Dec. 18, 1992, now abandoned, which is a continuation of application No. 07/599,978, filed on Oct. 19, 1990, now abandoned.

(30) Foreign Application Priority Data

| | | |
|---|---|---|
| Oct. 20, 1989 | (JP) | 1-274640 |
| Oct. 22, 1989 | (JP) | 1-274473 |
| Oct. 22, 1989 | (JP) | 1-274474 |
| Oct. 24, 1989 | (JP) | 1-274839 |

(51) Int. Cl.[7] ..... B41J 2/175
(52) U.S. Cl. ..... 347/86; 347/87
(58) Field of Search ..... 347/85–87

(56) References Cited

U.S. PATENT DOCUMENTS

| | | | | |
|---|---|---|---|---|
| 4,368,478 | A | 1/1983 | Koto | 346/140 R |
| 4,412,232 | A | 10/1983 | Weber et al. | 347/87 |
| 4,419,678 | A | 12/1983 | Kasugayama | 347/86 |
| 4,436,439 | A | 3/1984 | Koto | 400/126 |
| 4,658,273 | A | 4/1987 | Yuki et al. | 346/140 R |
| 4,791,438 | A | 12/1988 | Hanson et al. | 346/140 R |
| 4,931,811 | A | 6/1990 | Cowger et al. | 346/140 R |
| 4,967,207 | A | 10/1990 | Ruder | 346/140 R |
| 5,027,134 | A | 6/1991 | Harmon et al. | 346/140 R |
| 5,216,450 | A | 6/1993 | Koitabashi | 346/140 R |
| 6,224,275 | B1 | 5/2001 | Suzuki et al. | 400/124.1 |
| 6,247,803 | B1 * | 6/2001 | Kanaya et al. | 347/86 |

FOREIGN PATENT DOCUMENTS

| | | |
|---|---|---|
| EP | 139508 | 5/1985 |
| EP | 261764 | 3/1988 |
| FR | 2470956 | 6/1981 |
| JP | 57-002786 | 1/1982 |
| JP | 58-36457 | 3/1983 |
| JP | 58-53473 | 3/1983 |
| JP | 60-68959 | 4/1985 |
| JP | 1-148559 | 6/1989 |

* cited by examiner

*Primary Examiner*—Craig Hallacher
(74) *Attorney, Agent, or Firm*—Fitzpatrick, Cella, Harper & Scinto

(57) ABSTRACT

An ink jet head cartridge includes a recording head for ejecting ink; an ink container for containing the ink to be supplied to the recording head; an air venting opening for communication between the container and ambience to allow supply of the ink from the container to the recording head; wherein the air venting opening is constituted by an outside opening and an inside opening and a passage connecting them, the passage has a length larger than a thickness of the ink container.

5 Claims, 16 Drawing Sheets

INK JET APPARATUS AND INK JET CARTRIDGE AND INK CONTAINER MOUNTABLE THERETO

This application is a division of application Ser. No. 09/547,341, filed Apr. 11, 2000, allowed; which is a division of application Ser. No. 08/861,768 filed May 22, 1997; now U.S. Pat. No. 6,086,192, issued on Jul. 11, 2000; which is a continuation of application Ser. No. 08/627,366 filed Apr. 4, 1996, now U.S. Pat. No. 5,693,901; which is a continuation of application Ser. No. 08/323,050 filed Oct. 14, 1994, abandoned; which is a continuation of application Ser. No. 07/993,919 filed Dec. 18, 1992 abandoned; which is a continuation of application Ser. No. 07/599,978 filed Oct. 19, 1990, abandoned. This application is related to application Ser. No. 08/279,079, filed Jul. 22, 1994, now U.S. Pat. 5,557,310.

FIELD OF THE INVENTION AND RELATED ART

The present invention relates to an ink jet recording apparatus, an ink jet head cartridge mountable thereto and an ink container mountable thereto.

In a type of ink jet recording apparatus wherein ink is deposited on the recording material to effect the recording, an ink cartridge containing a predetermined quantity of the ink is exchangeable to replenish the ink jet recording apparatus with the ink. When the cost of the ink jet recording head is low, a head-container cartridge is used wherein the recording head and the ink container having a capacity of a predetermined quantity of the ink are constructed as a unit. In the latter type, the recording head is exchanged with fresh one each time after a predetermined amount of recording is effected. Therefore, the good recording quality can be maintained. Even if a trouble leading degraded recording quality occurred, the inoperable time period could be reduced, because the ink jet recording head which is the key element could be easily exchanged. In addition, the liability of introduction of foreign matter attributable to the replenishment of the ink can be avoided.

In such a head-container cartridge, the ink container containing the ink to be supplied to the ink ejector is provided, which is required to satisfy the following:

(1) The ink does not leak out;

(2) The ink does not evaporate;

(3) It contains a predetermined quantity of the ink and supplies it to the ejector; and (4) It does not obstruct the ink ejection by the ejector.

In order to practically satisfy the above functional requirements, an ink container of an ink bag type or a sponge type are known. In the latter type, an ink absorbing material is disposed in the ink container, so that the ink in the ejector is under the vacuum.

The ink bag type involves the problem regarding the above requirement (4). More particularly, in order to avoid the influence by the static head of the ink to the ejector, the relative positional relation between the recording head and the ink container is more or less limited. In addition, the ink bag should be protected by an outside casing for the purpose of easy handling, which results in the cost increase.

The sponge type is free from the influence to the ejection by the static head of the ink.

Referring first to FIG. 1, there is shown a perspective view of an ink jet head cartridge of this type. The cartridge includes an ink container 160, an ink jet recording head mounted to the ink container 160, porous material 162 in the ink containing portion 160*a*. The porous material 162 is filled with the ink. The ink is supplied to the ink jet recording head 164 by way of an integrating passage not shown.

Ejection outlets 163 of the ink jet recording head 164 receive image signals from the main assembly of the apparatus to eject the ink droplet onto a recording material. A connector 165 establishes electric connection between the main assembly and the recording head.

A small chamber 160*c* is formed at a part of the container 160. It communicates with the ink containing portion 160*a* in the container through a connecting groove 160*b*. An air venting hole 160*d* is formed in a part of the small chamber. Following the ink ejection for the image recording, the air is introduced through the air venting hole 160*d*. A cover 161 seals the ink containing portion 160*a* and the small chamber 160*c*. The ink jet cartridge described above is normally positioned in use with the recording head 164 at the bottom, and therefore, the air venting hole 160*d* at the top. Accordingly, the ink does not leak out of the cartridge.

The air venting hole is provided to compensate the pressure change due to the consumption of the ink in the ink container or due to the temperature change of the air in the ink container, by communication between the inside and outside of the container. However, in the conventional ink container, the ink is easily evaporated through the air venting hole (requirement (2)). The ink evaporates with time with the result of following problems.

For example, water ink which is widely used from the standpoint of safety, is generally constituted by water, dye and non-volatile solvent. With the evaporation, and therefore, reduction of the volatile contents such as water, decomposition of the ink significantly changes to such an extent that the recording property such as the fixing property and the image density is influenced and that the ejectors are clogged by the increase of the ink viscosity. In addition, usable quantity of the ink decreases so that it is not economical. It will be understood that the problems arising from the evaporation are significant particularly in the case of the ink container having a smaller capacity.

When the cartridge of the above-described example is left with the air venting hole at the bottom as shown in FIG. 2, or it is left with its horizontal position, the ink in the container gradually lowers due to the ambient temperature change or the like. Then, an ink layer is formed in the porous material 162 at the bottom at the side where the air venting communication groove is formed, and on the other hand, an air layer is formed at the top where the communication passage with the recording head is formed. If the temperature rises with this state, the inside pressure increases by the expansion of the air remaining in the container, so that the ink A is pushed to the outside through the communication groove 160*b* and through the air venting hole 160*d*, and therefore., the ink leaks out.

In addition, when an impact is applied to the ink container which is positioned with its air venting hole at the bottom, the ink droplets come out through the communication groove 160*b*, and the ink leaks out of the container through the air venting hole 160*d*.

When the ink jet cartridge described above is used with the ink ejection outlets 163 at the bottom as shown in FIG. 3, the ink remains in the region I which is indicated by the hatched lines and which is remote from the ink jet head 164 without being consumed.

It would be considered to incline the bottom 162*b* of the ink container in an attempt to prevent the ink from remaining. However, in order to accomplish this without reduction of the ink capacity, the ink jet recording head 164 has to be shifted downwardly toward the recording material. Then, the height of the entire apparatus 100 is increased, or the ink retaining performance decreases by the increase of the height of the ink absorbing material 162. Then, the ink is more easily leaked out through the ink ejection outlets 163.

SUMMARY OF THE INVENTION

Accordingly, it is a principal object of the present invention to provide an ink container, an ink jet recording head cartridge with the ink container as a unit and an ink jet recording apparatus using the same, wherein the evaporation of the ink can be suppressed for a long period of time, by which the good recording property can be stably maintained.

It is another object of the present invention to provide an ink container, an ink jet recording head with the ink container as a unit and an ink jet recording apparatus using the same wherein the leakage of the ink is effectively prevented.

It is a further object of the present invention to provide an ink container, an ink jet recording head cartridge with the ink container and an ink jet recording apparatus using the same, wherein the ink in the container is effectively supplied to the ink inlet of the recording head substantially without the ink remained in the container.

According to an aspect of the present invention, there is provided an ink jet head cartridge, comprising: a recording head for ejecting ink; an ink container for containing the ink to be supplied to said recording head; an air venting opening for communication between said container and ambience to allow supply of the ink from said container to said recording head; wherein said air venting opening is constituted by an outside opening and an inside opening and a passage connecting them, said passage has a length larger than a thickness of said ink container.

According to another aspect of the present invention, there is provided an ink jet recording apparatus, comprising: an ink jet head cartridge, including; a recording head for ejecting ink; an ink container for containing the ink to be supplied to said recording head; an air venting opening for communication between said container and ambience to allow supply of the ink from said container to said recording head; wherein said air venting opening is constituted by an outside opening and an inside opening and a passage connecting them, said passage has a length larger than a thickness of said ink container; said apparatus further comprising a carriage for movably supporting said cartridge.

According to a further aspect of the present invention, there is provided an ink container, comprising: an ink containing portion for containing ink; an opening for communicating between said ink containing portion and ambience; a tubular passage connecting the inside of said containing portion and said opening.

According to a further aspect of the present invention, there is provided an ink jet recording apparatus, comprising: an ink jet head unit having an ink passage provided with energy generating element for generating energy contributable to ejecting ink; an ink container, integrally formed as a unit with said ink jet head unit, having an ink containing portion for containing the ink to be supplied to said ink passage and having an opening for communication between an inside of said container and ambience; an air passage for communication between the inside of said ink containing portion to said opening; said ink jet head unit and said ink container constituting an ink jet head cartridge; and a member for mounting thereon said ink jet head cartridge.

According to a further aspect of the present invention, there is provided an ink jet head cartridge, comprising: a recording head for ejecting ink; an ink container for containing the ink to be supplied to said recording head; an ink absorbing material made of porous material or fibrous material in said ink container, wherein an inside of said ink container is in communication with ambience to permit supply of the ink from said ink container to said recording head; a small chamber in communication with said ink absorbing material substantially at a center of said ink container, said small chamber being provided with a projected opening in communication with the ambience.

According to a further aspect of the present invention, there is provided an ink jet recording apparatus, comprising: an ink jet head cartridge, including; a recording head for ejecting ink; an ink container for containing the ink to be supplied to said recording head; an ink absorbing material made of porous material or fibrous material in said ink container, wherein an inside of said ink container is in communication with ambience to permit supply of the ink from said ink container to said recording head; a small chamber in communication with said ink absorbing material substantially at a center of said ink container, said small chamber being provided with a projected opening in communication with the ambience; said apparatus further comprising a carriage for mounting thereon said ink jet head cartridge.

According to a further aspect of the present invention, there is provided an ink jet head cartridge, comprising: a recording head for ejecting ink; an ink container for containing the ink to be supplied to said recording head; an ink absorbing material made of porous or fibrous material in said ink container, wherein an inside of said ink container is communicated with ambience to permit supply of the ink from said ink container to said recording head, wherein said absorbing material has a higher density adjacent ink supply port for supporting the ink from said container to said recording head, and has a decreasing density away from the supply port; and a projection for providing the portion of the high density of said ink absorbing material by engagement with said ink absorbing material.

According to a further aspect of the present invention, there is provided an ink jet recording apparatus, comprising: an ink jet head cartridge, including; a recording head for ejecting ink; an ink container for containing the ink to be supplied to said recording head; an ink absorbing material made of porous or fibrous material in said ink container, wherein an inside of said ink container is communicated with ambience to permit supply of the ink from said ink container to said recording head, wherein said absorbing material has a higher density adjacent ink supply port for supporting the ink from said container to said recording head, and has a decreasing density away from the supply port; a projection for providing the portion of the high density of said ink absorbing material by engagement with said ink absorbing material; said apparatus further comprising a carriage for mounting said cartridge.

According to an embodiment of the present invention, a tubular communicating passage is extended from an inside space in the ink container of the ink jet head cartridge to the ambience, so that the space is opened to the ambience. Therefore, the evaporation of the ink in the container to the outside is impeded by the flow resistance provided by the long passage. Accordingly, by the suppression of the evaporation, the good and stabilized recording property can be maintained for a long period of time.

According to another embodiment, the ink container of the ink jet head cartridge as a small chamber, adjacent the center thereof, communicating with the absorbing material, and an air venting pipe projecting into the inside of the container and having a substantial length, by which when the ink jet head cartridge is left at any position, the leakage of the ink can be prevented.

According to this embodiment, the small chamber is formed adjacent the center of the ink container, and therefore, the strength of the ink container wall against deformation is enhanced, so that the ink jet cartridge has sufficient mechanical strength even if the container is made of thin walls.

According to a further embodiment of the present invention, the density of the ink absorbing material can be increased adjacent the ink supply port, so that the ink tends to gather toward the high density portion of the ink absorbing material by the capillary action, and therefore, even when the remaining amount of the ink becomes small, the ink is concentrated at the ink supply port side, by which substantially all the ink can be supplied to the ink jet recording head.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, an embodiment of the present invention will be described.

Figure 4:
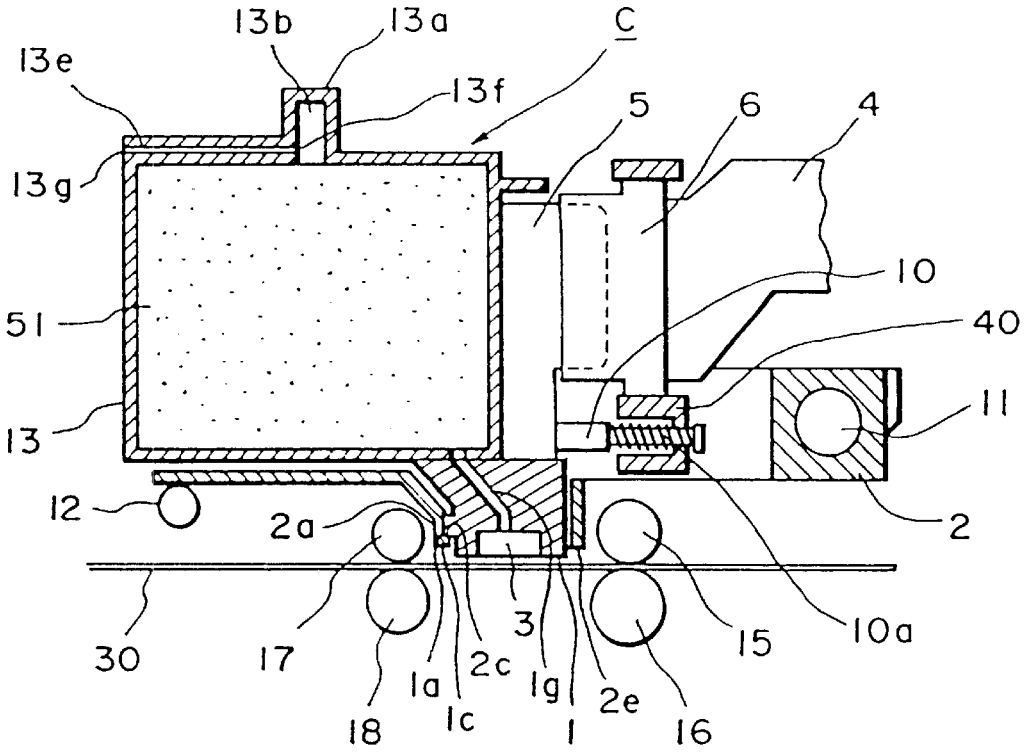
FIG. 4 is a sectional view of an ink jet recording apparatus according to an embodiment of the present invention.

Referring to FIG. 4, there is shown an ink jet recording head according to an embodiment of the present invention. A carriage 2 for detachably supporting a cartridge C having the recording head 1 and is slidably mounted on a rail 11. The carriage 2 is supported at the opposite side by a sliding rail 12. It moves to scan the recording medium 30 to effect the recording thereon. While the carriage 2 moves scanningly, plural ejection outlets 3 of the recording head 1 eject droplets of the ink supplied from an ink container 13 in accordance with the image information, so that characters or figures are recorded on the recording medium 30. To effect this, the recording head 1 is provided with plural electrothermal transducers (not shown) to form the ink droplets in accordance with the image information. The recording medium 30 is fed by the feeding rollers 15, 16, 17 and 18 in accordance with the image recording. The ink jet recording head cartridge C has a recording head 1 and the ink container 13, and is detachably mountable on the carriage 2.

An abutment surface 1*a* and another abutment surface not shown of the recording head 1 are abutted to and pressed to an abutment surface 2*a* and another abutment surface not shown of the carriage 2, so that the recording head 1 is correctly positioned relative to the carriage 2. More particularly, a pushing rod 10 engaged with a holding member 40 applies pressure to the recording head 1, and.the abutment surface 1*a* of the recording head 1 is abutted to the abutment surface 2*a* of the carriage 2, by which the recording head 1 is correctly positioned in the horizontal directions relative to the carriage 2. Since the pushing rod 10 and the unshown abutment surface of the recording head 1 establishes slanted surface contact, the resultant component force abuts an abutment surface 1*c* of the recording head 1 to an abutment surface 2*c* of the carriage 2, by which the recording head 1 is correctly positioned in the vertical direction. The pushing rod 10 is urged by a coil spring 10*a*.

On the other hand, the holding member 40 is provided with a connector 6 for transmitting image signals from the main assembly of the recording apparatus through signal transmitting cables 4. The connector 6 is contactable with the head connector of the cartridge 1.

Therefore, when the holding member moves to the right, the engaging portion 10*a* of the pin 10 abuts the holding member 40 to release the recording head, and simultaneously, to disengage the cartridge connector 5 from the main assembly connector 6 to permit the entire release of the cartridge C.

The container 13 contains an ink absorbing material 51 made of porous or fibrous material to retain the ink therein.

Because of the provision of the ink absorbing material 51, the easy movement of the inside ink is prevented even upon vibration or impact applied to the cartridge, and therefore, the ink leakage or the adverse influence to the printing can be prevented. The ink is supplied to ejection nozzles 3 through the bottom communicating passage 1*g* of the ink container 13. The ink is then ejected to the recording material in accordance with the image recording signals supplied from the main assembly through the head connector 5, so that an image is formed on the recording medium 30.

A small cavity or chamber 113*b* is formed in the container and is effective to retain tentatively the small quantity of the ink woozing from the absorbing material 51 so as to prevent the ink leaking out of the ink container. An air venting passage 13*e* is effective to introduce the outside air into the container, following the reduction of the quantity of the ink therein by the consumption thereof.

Figure 5:
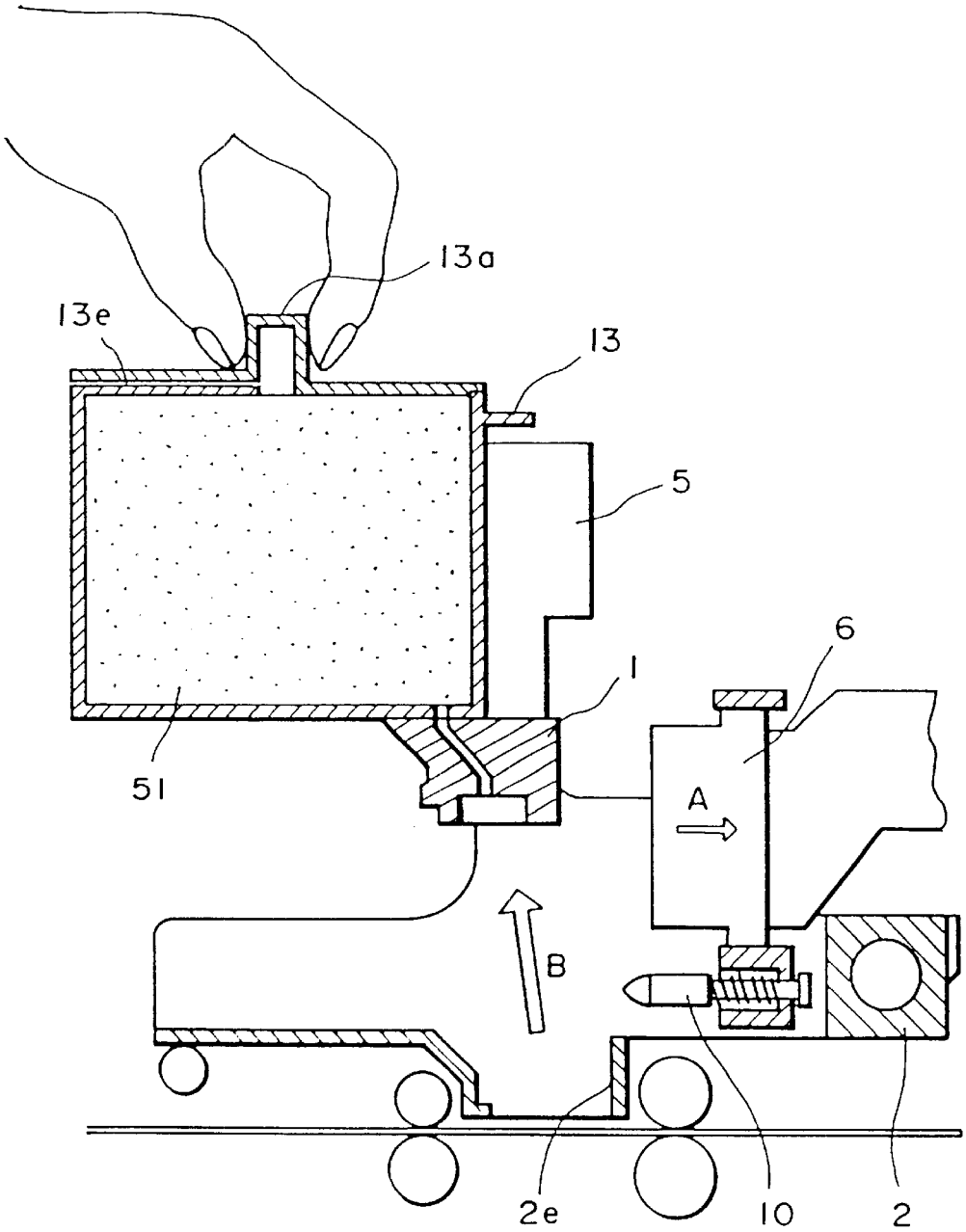
FIG. 5 is a sectional view of the ink jet recording apparatus illustrating mounting and dismounting of the cartridge relative to the ink jet recording apparatus.

FIG. 5 shows the recording apparatus when the recording head is being dismounted therefrom. When the recording head is released, the connector holder 40 moves to the right (arrow A). Upon this movement, the recording head 1 abuts a rough guide 2*e*, so that the movement is limited. Therefore, the main assembly connector 5 and the head connector 5 are disengaged from each other, so that the pressed state of the recording head 1 is released, so that the recording head is released from the positioned state.

As shown in the Figure, the head connector 5 of the recording head 1 is disengaged from the main assembly connector 6, and the pushing rod 10 is disengaged from the recording head 1. Then, the cartridge C is permitted to be dismounted in the detection indicated by an arrow by the operators hand gripping a grip 13*a* projected from the top of the ink container 13.

Figure 6:
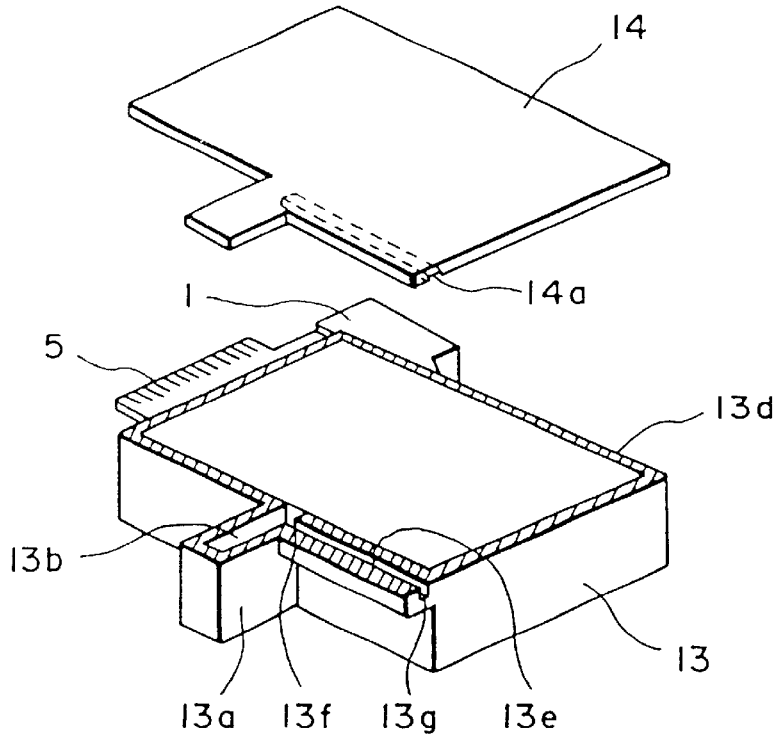
FIG. 6 is an exploded perspective view of the ink jet recording head cartridge according to the present invention.

FIG. 6 is an exploded perspective view of the ink jet recording head cartridge. A cover 14 is joined and sealed with the main body of the container 13 by ultrasonic wave fusing or the like, so that an ink container of the ink jet recording cartridge is constituted. In a part of the junction surface 13*d* indicated by hatched lines, between the main body of the container 13 and the cover 14, an air venting groove 13*e* is formed to provide communication between an inside opening 13*f* near the small chamber 13*b* and an outside opening 13*g* near the outside. When the main body 13 and the cover 14 are joined, the air venting passage 13*e* is formed.

In this embodiment, the groove forming the air venting passage 13*e* is formed at each of the main body of the tank 13 and the cover 14 (13*e* and 13*a*). However, it is a possible alternative that the groove is formed only in one of them. This applies also to the other embodiments which will be described hereinafter.

The venting passage 13*e* has a small diameter (cross-sectional area), and the communicating passage between the inside opening 13*f* and the outside opening 13*g* is larger than the depth of the container. By reducing the passage diameter and increasing the communicating passage, the evaporation of the ink in the container is very effectively suppressed. If, however, the passage diameter is too small, it becomes difficult to form the air venting passage, and if it is too large, the evaporation of the ink is not effectively suppressed. In consideration of them, the diameter is preferably 0.1–2 mm. In this embodiment it is 1 mm. On the other hand, the length of the communicating passage has sufficient length to effectively suppress the evaporation of the ink in connection with the diameter. It is preferably larger than the thickness of the ink container. Practically, the upper limit of the length of the communicating passage in the ink container having the structure as described above, is preferably $10 \geqq 150$ mm. In this embodiment, it is 29 mm.

Figure 7:
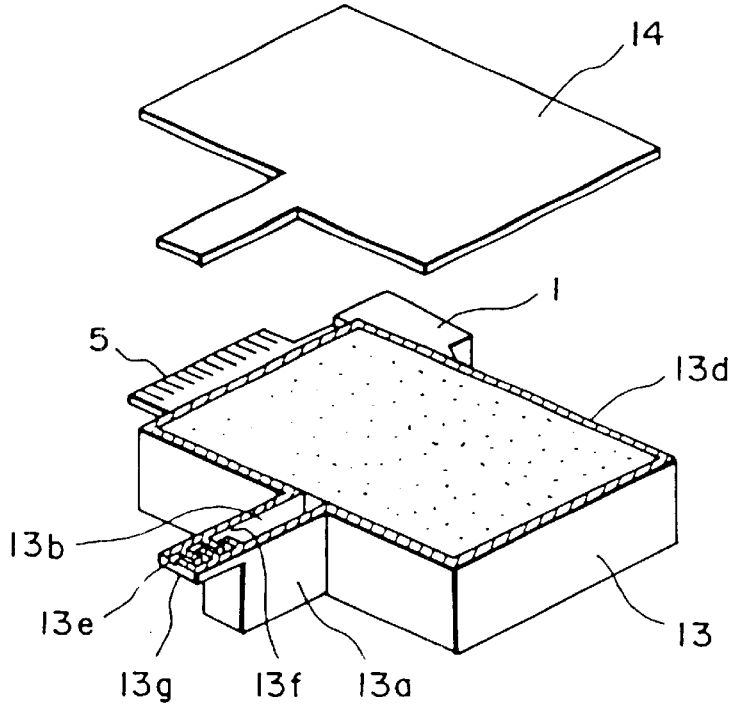
FIG. 7 is an ink jet recording head cartridge according to another embodiment of the present invention.

FIG. 7 shows another embodiment, wherein the air venting groove is cranked, by which the long air venting passage can be disposed in the small space.

Figure 8:
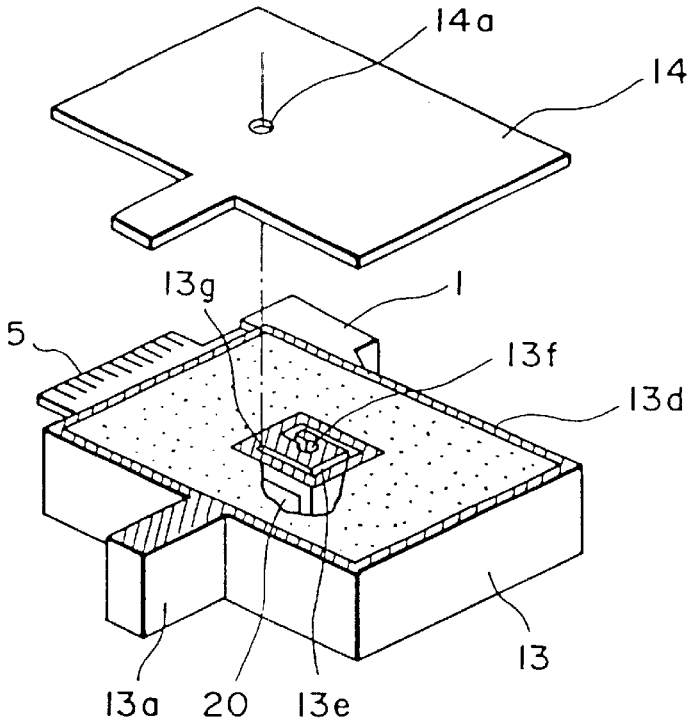
FIG. 8 is an exploded perspective view of the ink jet recording head cartridge according to a further embodiment of the present invention.

FIG. 8 shows a further embodiment, wherein the small chamber is disposed adjacent the center of the container, wherein a communicating hole 20*a* communicating with the small chamber is connected with an end of an air venting groove 20*b* which is helically formed. The cover 14 has a communicating hole 14*a* (external opening) formed at a position corresponding to the other end 20*c* of the air venting groove 20*b*, by which when the cover 14 is jointed with the main body of the container, the air venting communication is established through the groove.

Figure 9:
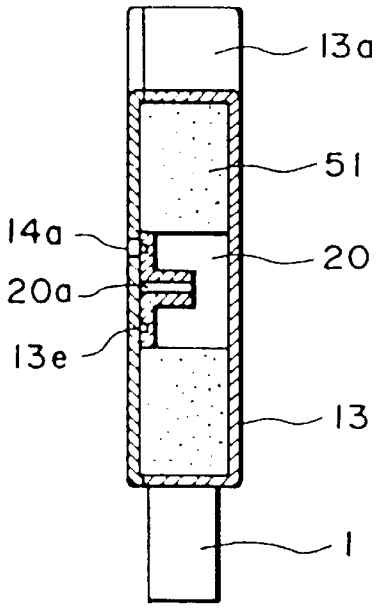
FIG. 9 is a sectional view of the cartridge of FIG. 8.

FIG. 9 is a sectional view of the container of FIG. 8 embodiment. The small chamber 20 communicates with the absorbing material 51 retaining the ink, and there is a communicating hole 20*a* adjacent the center of the small chamber. Therefore, the inside of the container and the outside are communicated through the small chamber 20, the communication hole 20*a*, the air venting passage 20*b* and the communication hole 14*a*.

As described in the foregoing, the small chamber 20 is formed adjacent the center of the ink container, and an internal opening of the air venting passage is formed adjacent the center of the space of the small chamber 20, and in addition the communicating passage is helical, by which the length of the air venting communicating passage can be very easily increased.

In this embodiment, the small chamber 20 is constituted by partition walls extending from one side wall and the other side wall of the ink container, substantially at the center of the ink container.

The inside dimensions of the ink container 13 of the ink jet recording head cartridge C of this embodiment are 50 mm in length (in the direction of the ink ejection), 65 mm in the width (perpendicular to the ink ejection detection) and 15 mm in the thickness (in the scanning direction of the carriage). The partition walls are formed as substantially rectangular cavity having a length of 13 mm and a width of 16 mm in the region away from the top and bottom walls by 18.5 mm, and away from the left and right walls by 24.5 mm. The volume of the small chamber is 2 cc, and the ink container volume not including the small chamber 20 is 43 cc.

In this embodiment, the small chamber 20 has the dimensions and the volume described above, but it is not limited to the above figures. For example, the small chamber 20 has $1/10$–$1/30$ of the volume of the ink container, preferably $1/15$–$1/40$, further preferably $1/20$–$1/30$ of the volume of the ink container.

If the volume of the small chamber 20 is too large, the capacity of the ink container 13 becomes too small. If, on the other hand, the small chamber is too small, it is easily filled with the ink woozed thereinto by the ambient condition change, and therefore, there occurs a liability that the ink is leaked out through the air venting communication passage 21. Therefore, the above-described range is preferable.

The air venting passage 20*a* in the small chamber 20 is provided by a cylindrical stub so disposed that the inner opening 13*f* is disposed substantially at the center of the space of the small chamber 20.

In this embodiment, since the thickness of the ink container is 15 mm, the end opening 21*a* is disposed in the region away from the side wall by 7.5 mm.

The diameter of the opening is 2 mm, and the diameter of the passage is 1 mm. The total length of the stub passage and the helical passage is 36.5 mm in this embodiment.

Since the internal opening 13*f* of the air venting passage is disposed substantially at the center of the space of the small chamber 20, as described above, the ink is prevented from leaking outside, and the evaporation of the ink is sufficiently suppressed, even if the ink is woozed into the small chamber 20 due to the ambient condition change or the like, irrespective of the orientation of the ink jet head cartridge C.

In the foregoing embodiment, the ink is contained in the absorbing material. The absorbing material preferably has a high density (compressed) adjacent the ink inlet port of the recording head, since then, even if the remaining amount of the ink in the container becomes small, the ink can be supplied to the ink supply port in good order, and therefore, substantially all of the ink in the container can be used. In addition, in the commercial distribution system, the portion of the absorbing material adjacent the ink supply port can be filled with the ink, so that the ink can be assuredly ejected property even at the initial stage of the use of the cartridge.

As described in the foregoing, according to this embodiment, a groove or grooves communicating the inside of the container to the outside are formed at one or both of the junction surface or surfaces of the member constituting the ink container, and an air venting passage for communication between the outside and inside of the ink container is constituted when the member are joined. Therefore, a small diameter and long communication passage can be formed using a part or parts of the constituent parts of the ink container, so that an ink jet recording cartridge of small size wherein the ink evaporation is small can be provided with a simple structure.

Figure 10:
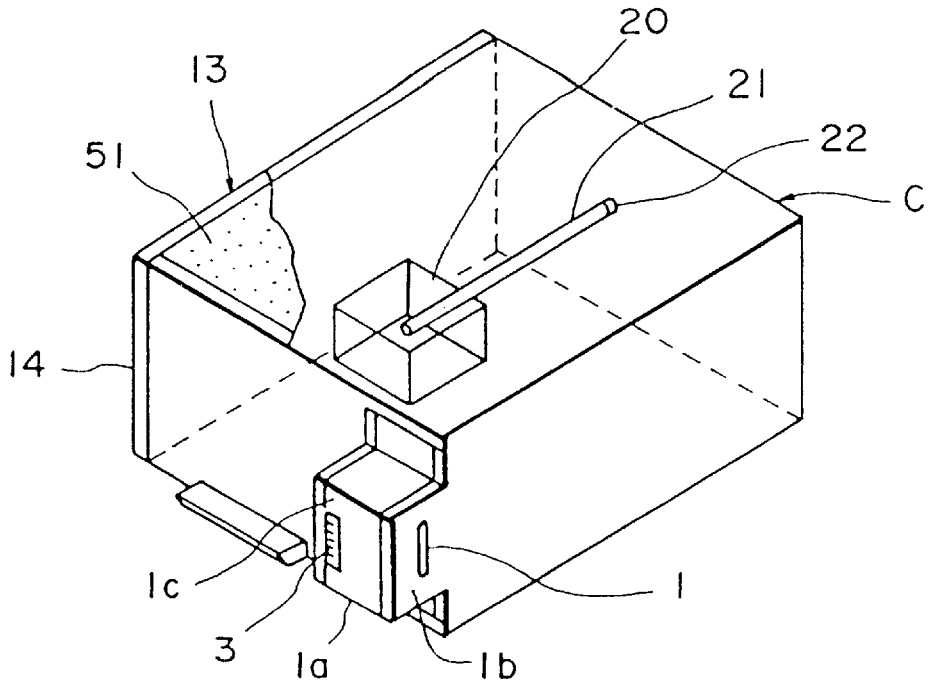
FIG. 10 is a perspective view of an ink jet recording head cartridge according to a further embodiment of the present invention.
Figure 11:
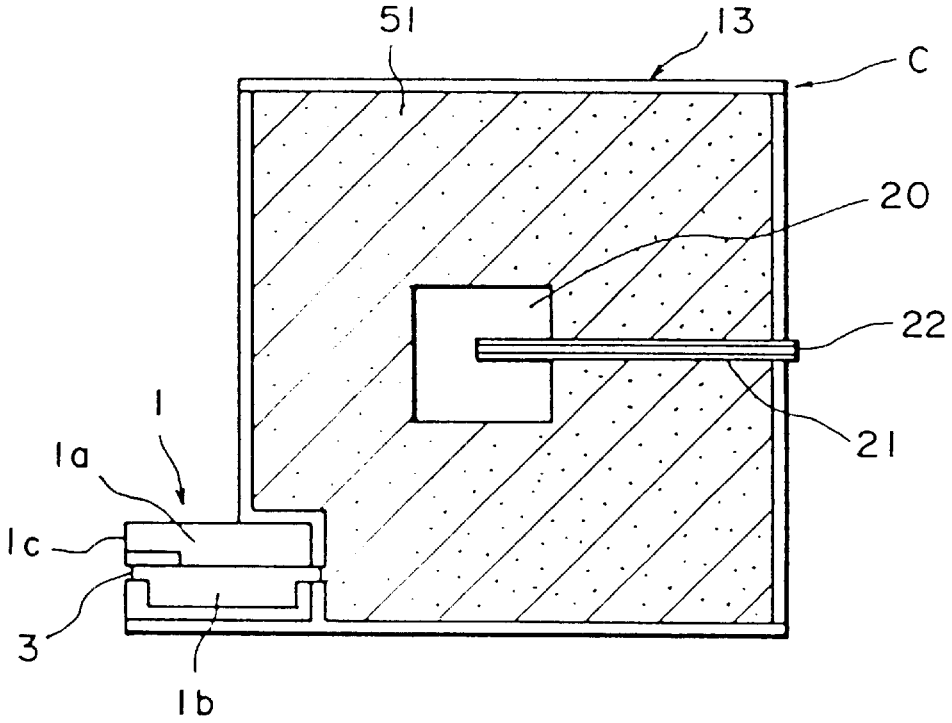
FIG. 11 is a sectional view of the cartridge of FIG. 10.

Referring to FIGS. 10 and 11, another embodiment will be described wherein an elongated air venting passage is also formed in an ink jet recording head cartridge. A cartridge C in this embodiment includes a recording head and an ink container as a unit, and is detachably mountable on a carriage of an ink jet recording apparatus the cartridge C has a recording head unit 1, an ejector 1*a* constituted by elements for performing the ink ejection, and an ink supply container for supplying ink to the ejector 1*a*. The ejector 1*a* includes a plurality of ejection outlets 3 arranged in an ejection side surface 1*c*, ink passages not shown, for supplying the ink to the ejection outlets 3, ejection energy generating elements such as electrothermal transducers disposed in the passages, and a common chamber communicating with the respective passages.

The ink container 13 of the cartridge C has a cover 14 and an ink absorbing material 51 in the ink container 13. The ink absorbing material 51 is made of porous or fibrous material and is impregnated with the ink. The ink container 13 has a small chamber or cavity or buffer chamber at substantially the center of the ink absorbing material 51. Between the buffer chamber 20 and the outside of the cartridge, an air venting pipe 21 having a small diameter with the opening 22 is disposed.

Figure 12:
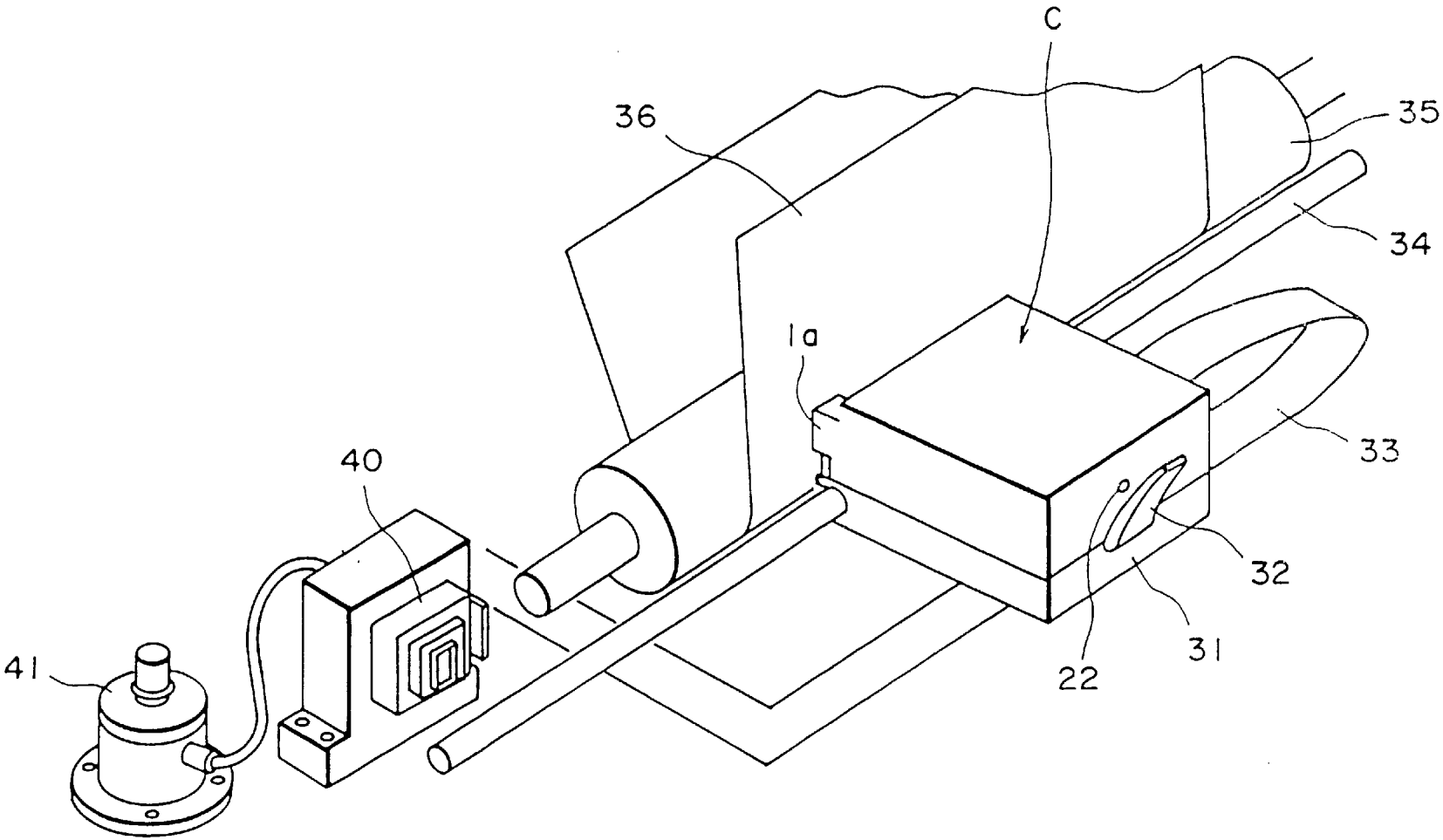
FIG. 12 is a perspective view of a part of an ink jet recording apparatus to which the cartridge of FIG. 10 is mounted.

FIG. 12 shows an ink jet recording apparatus usable with a recording head cartridge C having the recording head and the ink container as a unit. It comprises a carriage 31 carrying the recording head, a confining member for fixing the recording head C correctly positioned relative to the carriage 31 and a flexible cable 33 connected with an unshown connector on the carriage 31 to supply the ejection signals to the ejector 1*a* in accordance with the recording data. The positioning of the recording head C relative to the carriage 31 is accomplished by engaging an engagement hole of the recording head C with an engagement projection of the carriage 31, for example (not shown).

The carriage 31 carrying the recording head C is moved along a guiding shaft 34 by an unshown driving means, and during the movement, the ink is ejected through the ejection outlet 3 of the ejector 1*a* onto the recording material (recording sheet) supported on a platen 35. A capping member 40 operates when the ejector 3 of the recording head C is moved to the neighborhood of the left home position in FIG. 12. It contacts or approach the ejection surface 1*c*, and sucks the ink through the ejection outlet 3 with the aid of a suction pump 41, thus performing the ejector recovering operation.

Referring back to FIGS. 10 and 11, in order to prevent the ink from leaking through the air venting hole of the ink tank or through the ejection outlets due to the change in the ambient conditions such as temperature or the like, there are provided a buffer chamber 20 and the venting pipe 21. When the ambient temperature increases, the volume of the ink absorbed in the ink absorbing material 51 increases, and the expanded volume of the ink is eased out to the buffer chamber 20, but is not red to the outside through the venting pipe 21 and is retained in the buffer chamber 20. With the decrease of the ambient temperature to the normal temperature, the woozed ink is absorbed back into the ink absorbing material 51.

In this embodiment, the buffer chamber 20 is disposed substantially at the center of the ink absorbing material 51, by which the ink is effectively woozed and absorbed again. However, the position thereof is not limited to the center of the ink absorbing material 51, if the volume thereof is sufficient to accommodate the expanded ink. However, it is preferable that the air venting pipe 21 is extended to substantially the center of the buffer chamber 20 so as to dispose the buffer chamber 20 side opening adjacent the center from the standpoint of preventing the ink woozed into the buffer chamber 20 from being directed to the air venting pipe 21.

According to this embodiment, the buffer chamber 20 and the outside are communicated by a small diameter and long pipe 21, and therefore, the ink evaporation is suppressed by the low resistance of the pipe, as compared with the conventional structure in which the air venting hole is formed in the wall of the type. In addition, the liability of the ink clogging is decreased.

Figure 13:
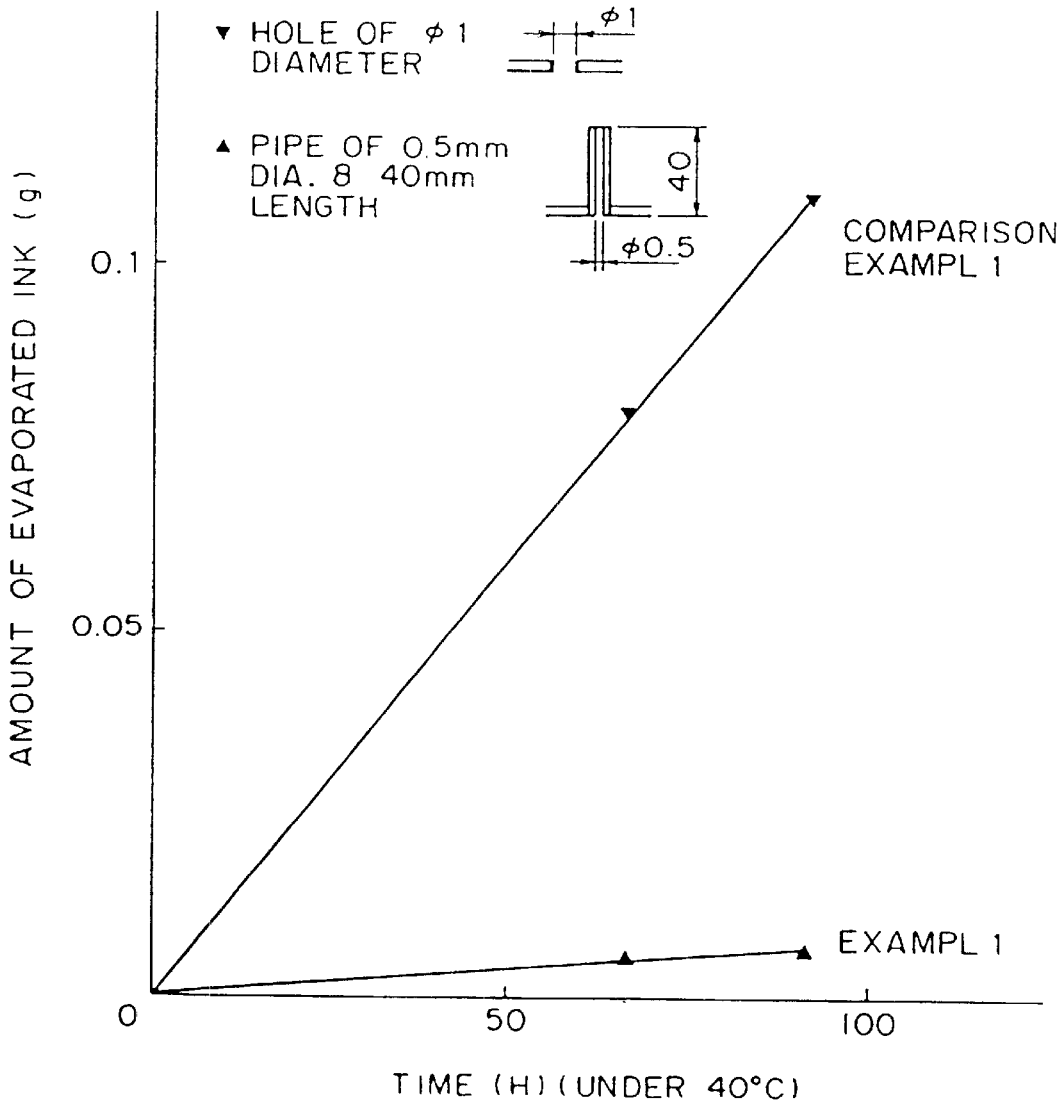
FIGS. 13, 14 and 15 are graphs showing the ink evaporation properties from the ink container.

FIG. 13 is a graph showing the evaporation preventing effect through the venting passage.

The ambient conditions of the tests are selected to be 40° C. in the temperature and 30% in the humidity as the conditions under which the evaporation of the ink is rather promoted. The ejector outlets la are covered with the capping member 40. The comparison is made between a comparison example wherein the outside wall of the ink container of the cartridge is provided with an air venting hole having a diameter of 1 mm and an embodiment of the present invention (Example 1) wherein the air venting pipe is made of glass pipe having an inner diameter of 0.5 mm and a length of 40 mm.

As will be understood from the graph, the quantity of evaporation in the embodiment is one tenth the Comparison Example 1. Therefore, the trouble such as ejection failure or the like attributable to the ink evaporation can be minimized. The contents in the ink used were as follows:

Diethylene glycol (DEG): 15%

Ethanol: 5%

Black dye: 3%

Water: 77% of these contents, the water and ethanol are evaporated. If they are evaporated too much as in the Comparison Example 1, the contents of DEG and the dye are increased with the result of deteriorated recording property such as insufficient fixture on the recording sheet and the unstable image density. In the worst case, the ejector 1*a* may be clogged with the ink which is increased in the viscosity. In this embodiment, the initial quantity of the ink is 40 g. Even if the composition contents of the ink changes by the slight evaporation, there occurs no practical problem, so that the high recording quality has been maintained. In addition, the running cost increase attributable to the reduction of the effectively usable quantity of the ink can be minimized.

Figure 14:
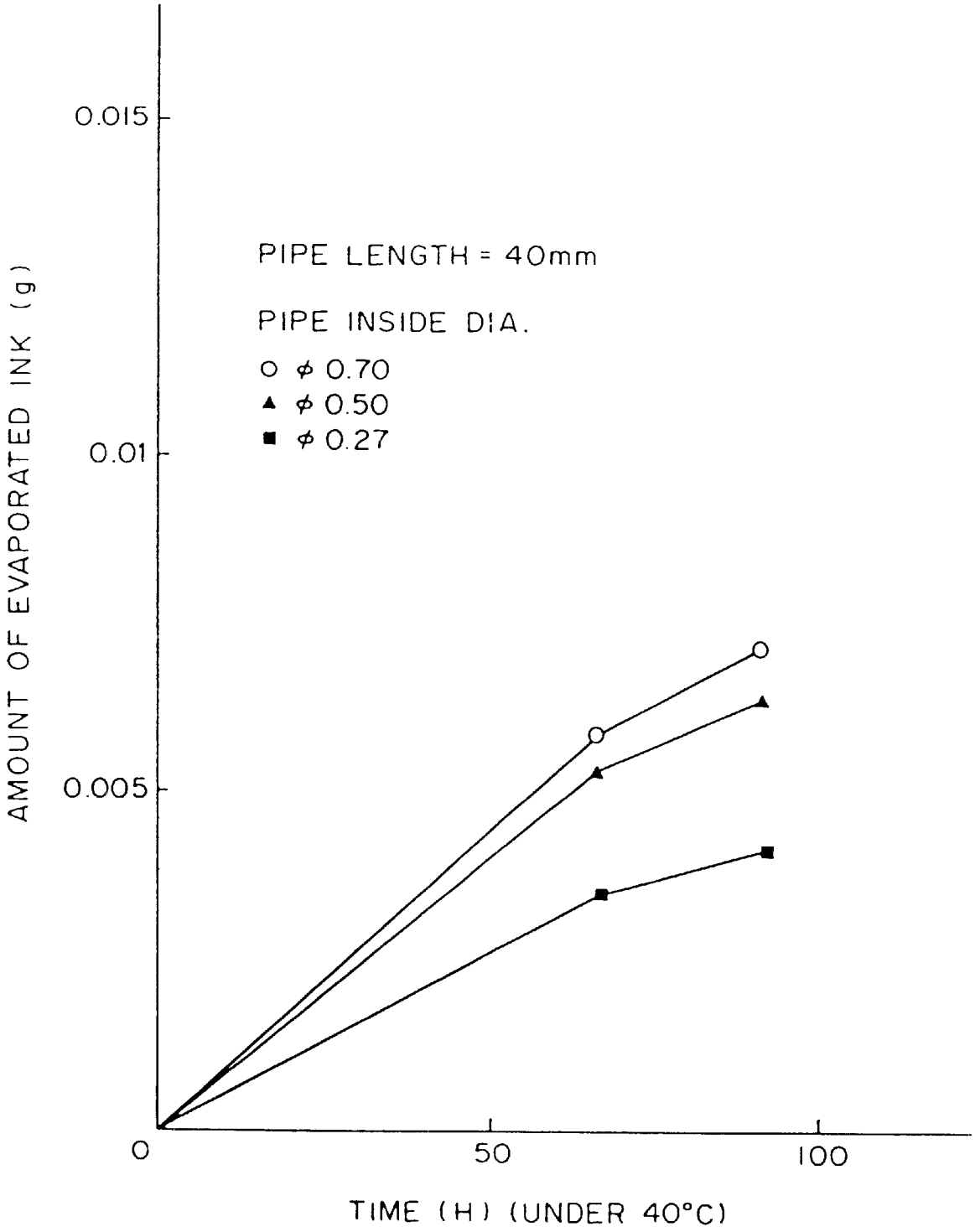
Figure 15:
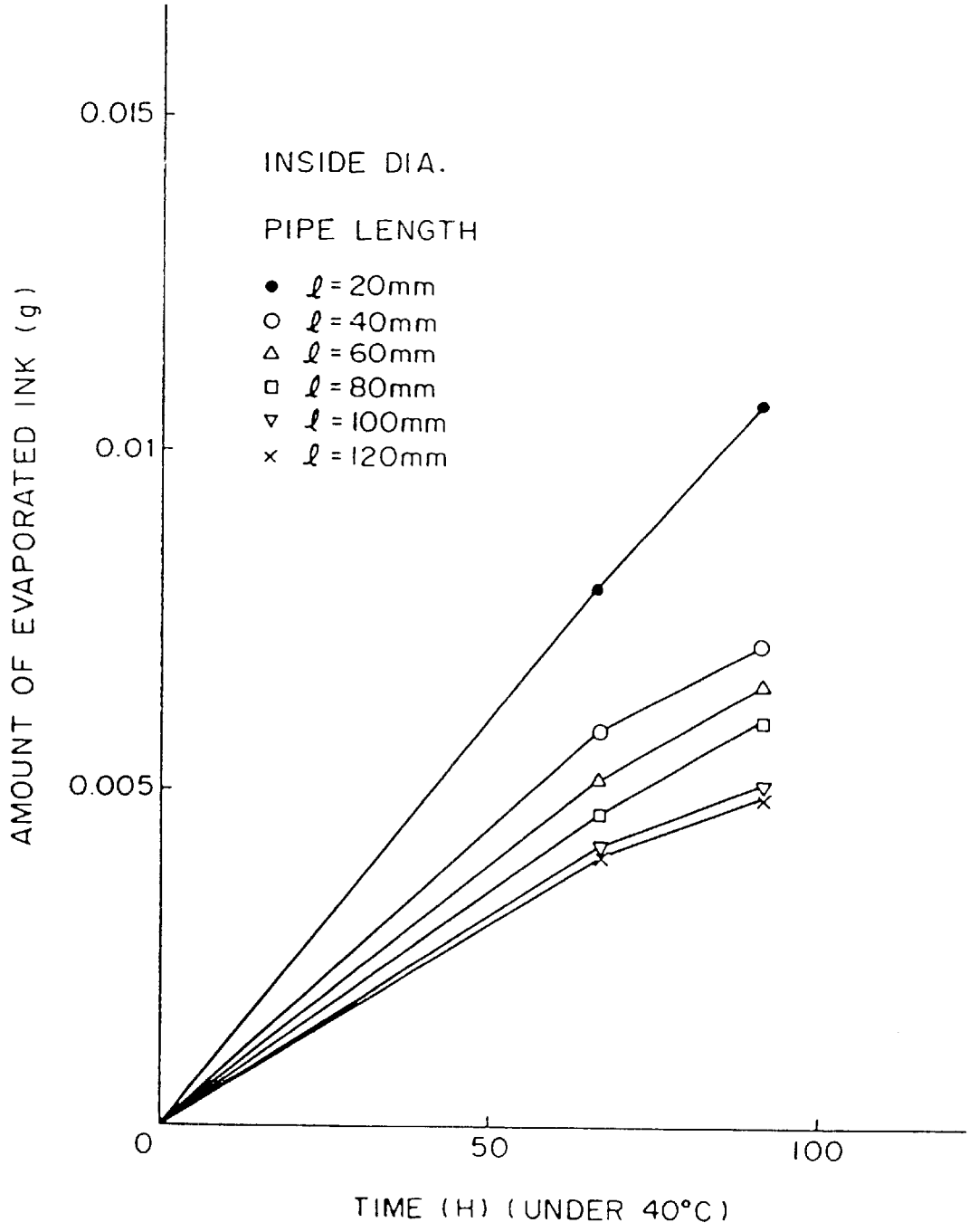

FIGS. 14 and 15 show the evaporation suppressing effects in the modified embodiments wherein the inside diameter and the length of the air venting pipe are changed.

In these modified embodiments, there are provided the buffer chamber and the air communicating pipe having such an inside diameter and a length as not have been realized due to the limitation of the mold design and/or due to the limitation by the prevention of the ink clogging when a hole is formed in a part of the container wall, as in the conventional structures. As will be understood from these Figures, the evaporation of the ink can be suppressed. In these embodiments, the air venting pipe is made of glass, but it may be made of plastic resin tube, depending on the inside diameter and the length thereof. The material is not limited.

Figure 16:
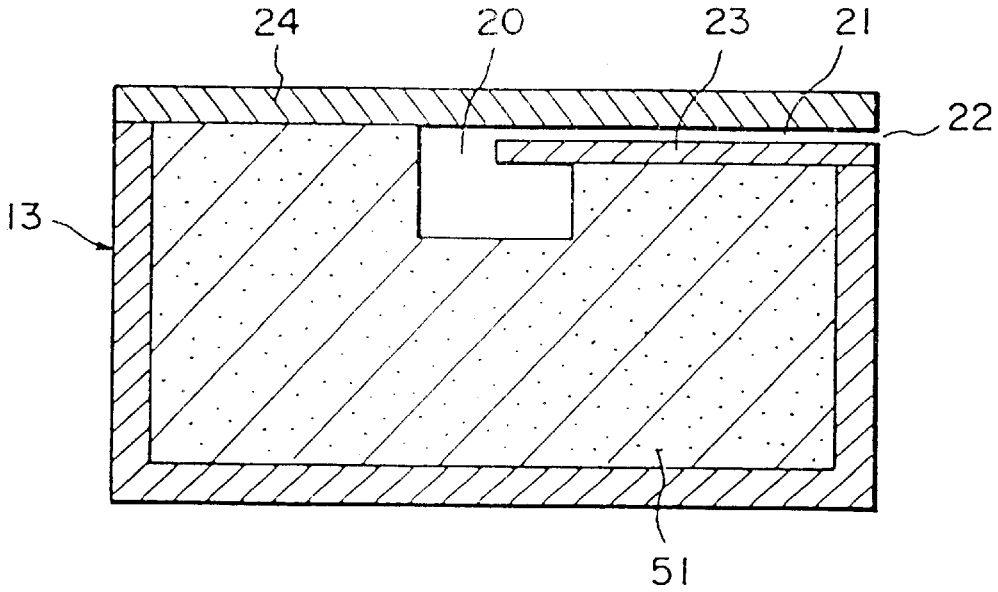
FIG. 16 is a sectional view of an ink jet recording head cartridge according to a further embodiment of the present invention.

FIG. 16 shows an ink container according to a further embodiment. The ink container is a part of a recording head cartridge having the recording head and the container as a unit. FIG. 16 shows only the ink container. The ink container 13 has a main body and a cover 24 on the top of the ink container 13. In this embodiment, the cavity, that is, the buffer chamber 20 in the ink absorbing material 51 is disposed adjacent the top of the ink absorbing material 51, and the air venting passage 21 is formed along the cover 24 toward the buffer chamber 20. A passage forming member 23 is made of resin material and formed the air venting passage 21 with the cover 24. Thus, the long passage 21 having a small cross-sectional area which is not easily produced by an integral molding method can be easily formed by such a combination. Designated by a reference numeral 22 is a venting opening.

Because of the above-described structure, the air venting passage can be easily formed at low cost. In this embodiment, the air venting passage 21 is formed using the cover member 24 in the ink container 13. Another combination of the constituent parts of the ink container may be used in place thereof.

The recording head cartridge of this type was mounted on a recording apparatus similarly to the case of the foregoing cartridge, and the shelf test and the recording tests were carried out. As a result, it was confirmed that good images were produced.

Figure 17:
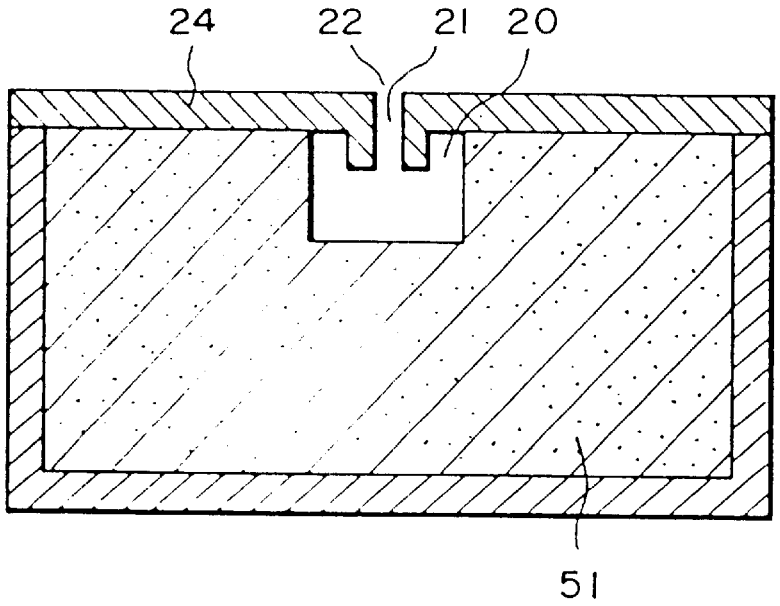
FIG. 17 is a sectional view of the ink jet recording head cartridge as a comparison example relative to the embodiments of the present invention.

FIG. 17 shows a structure of a Comparison Example wherein a short air venting passage 21 is directly formed by the molding in the cover 24, and the comparison was made with the present embodiment. The air venting communication passage 210 of the present invention had a cross-section of 0.24 mm×0.24 mm and had a length of 40 mm. The passage 211 of the Comparison Example had a circular cross-section having a diameter of 1.0 mm, and the length thereof was 5 mm, because of the limitations in the molding process. The quantities of evaporation and the recording properties are compared. The ink was the same as in the first example. The initial quantity of the ink was 30 cc, and the recording head was left for one month and for three months under the conditions of 30° C. (temperature) and 20% (humidity). The results are shown in the following Table 1.

TABLE 1

| | Test Results | | | | | |
|---|---|---|---|---|---|---|
| | Reflection image density (OD) | Fixing (sec.) | Maximum permissible rest period (sec.) | Solidification (hr.) | Print quality | Ejection failure |
| Initial | 1.3 | 10 | 80 | 10 | Good | ≦1/1000 |
| 1 month after (Embodiment) | 1.3 | 10 | 80 | 10 | Good | ≦1/1000 |
| 1 month after (Comparison Ex.) | 1.35 | 15 | 60 | 8 | Slightly feathering | =1/500 |
| 3 month after (Embodiment) | 1.3 | 10 | 75 | 10 | Good | ≦1/1000 |
| 3 month after (Comparison Ex.) | 1.5 | 20 | 30 | 5 | Solid black is slightly scratchy | =1/200 |

As will be understood from the above Table, the recording head cartridge of this embodiment was substantially free from the ink evaporation and the change in the composition, as compared with the initial conditions of the test.

The reflection image density was measured by MacBeth reflection density meter for a solid image in the right square (1 cm×1 cm).

Fixing property was evaluated by the presence or absence of tail when a solid image (1 cm×1 cm) is printed on a paper material (plain paper), and after a predetermined period, it is rubbed with Silbon C (trade name, available from Kojin Shoji, Japan) paper at a predetermined pressure.

Maximum permissible rest period means the maximum rest period between adjacent ejections by a certain ejection outlet, under the condition that the latter ejection is good order.

The solidification is represented by the time (hours) until the ink extracted from the cartridge under the condition of 15° C. temperature and 10% humidity into a capillary tube, becomes non-fluidable in an oven of 60° C. and 5%.

The print quality was evaluated on the basis of prints of various patterns.

The ejection failure is defined as a number print having the ejection failure to the total number of prints, when the printing operation was continued.

In the foregoing embodiments, the buffer chamber is disposed substantially at the center of the ink container, and therefore, the elongated air venting passage can be accommodated in the ink container. It is a possible alternative that the air venting pipe 21 is made of elastic tube, and the tube is snaked in the container, or that the groove formed in the passage forming member 21 is snaked, by which the length of the passage is increased. As a further alternative, the groove may be formed in the cover 24.

Figure 18:
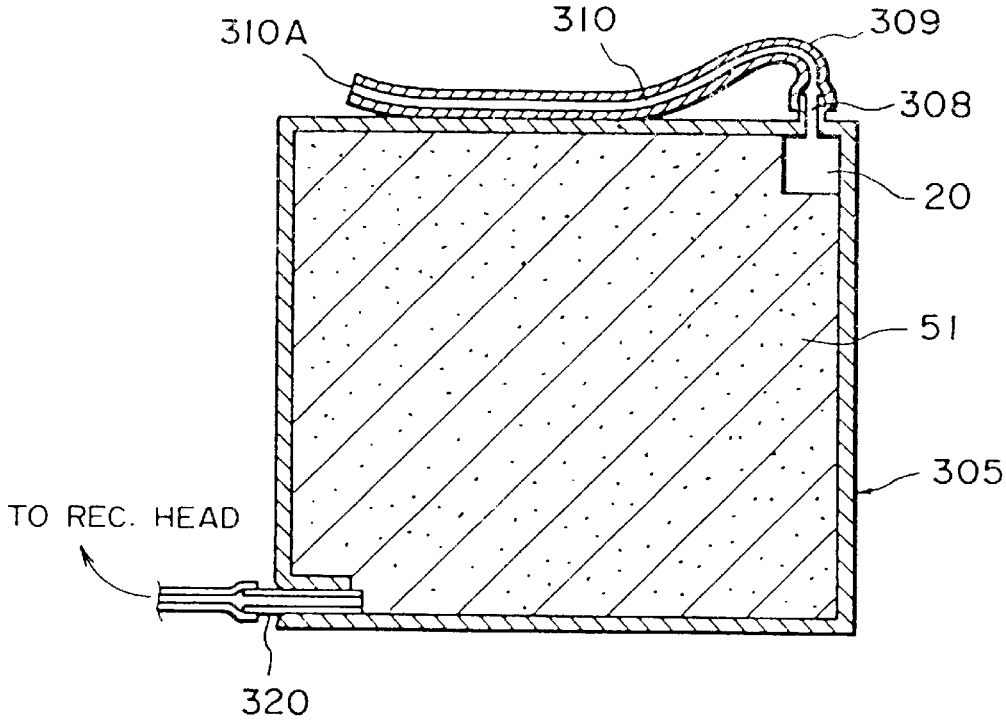
FIG. 18 is a sectional view of an ink container according to an embodiment of the present invention.

FIG. 18 shows a further embodiment. In this embodiment, the ink container itself is replaceable in an ink jet recording head cartridge usable with an ink jet recording apparatus. The ink container 305 the ink container is designated by a reference numeral 305. Before the ink container 305 is mounted into the main assembly of the recording apparatus, an ink supply port 306 of the recording head is hermetically sealed by a sealing member 307 made of aluminum or the like, and in addition, an opening 310A at an end of the communication passage 310 extended from the communication opening 308 of the container by the cube 309 is similarly sealed by a sealing member 311. The sealing members 307 and 311 have sufficient mechanical strength not to be broken even if the liquid pressure in the container 306 changes by the change in the ambient conditions. In addition, because of the provision of the buffer chamber, the communication passage 310 is not wetted with the ink. When it is mounted in the ink jet recording apparatus which is of a known type, the sealing member 311 for the passage 310 is peeled off, and an ink needle 320 connected to an unshown recording head is inserted through the sealing member 307 made of aluminum foil or the like into the supply opening. According to this embodiment, the evaporation of the ink after the ink container is opened can be suppressed by a simple structure constituted by a tube 309 connected to the opening 308 of the ink container 305.

In this embodiment, a communication passage 310 by the tube 309 is disposed outside the ink container 305. The air venting passage 310 made of tube or the like may be disposed in the main assembly of the recording apparatus, when the ink container or the head-container cartridge is normally mounted in the main assembly of the ink jet recording apparatus.

As described in the foregoing, according to the present invention, a tubular communicating passage is extended from a space in the ink container, and the extended end is opened to the air, and therefore, the evaporation of the ink can be minimized, so that the recording property can be maintained with the reduction of the running cost.

Figure 19:
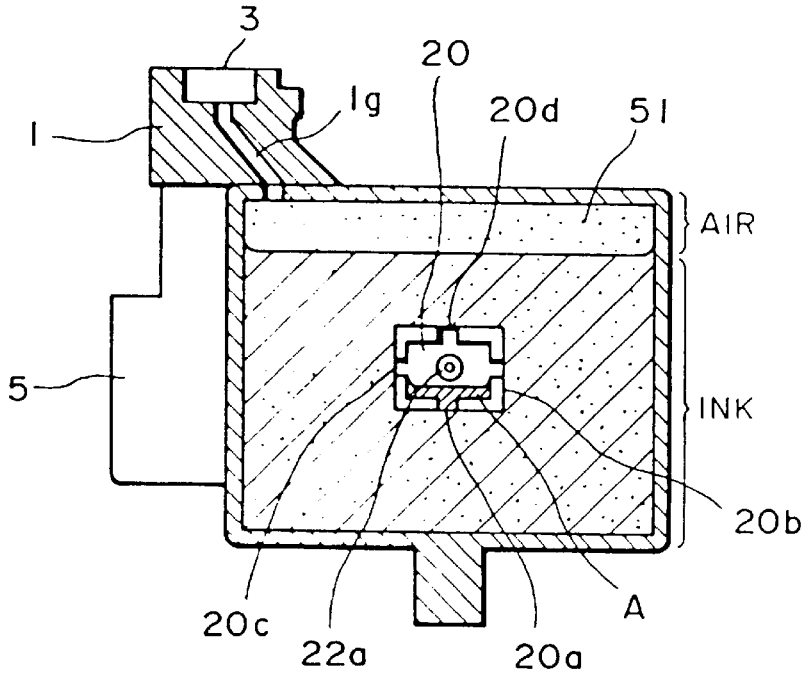
FIG. 19 is a sectional view of an ink jet recording cartridge according to a further embodiment of the present invention when it is kept in the shown state for a substantial period.

FIG. 19 shows an ink jet recording head cartridge according to a further embodiment, wherein the ink container 13 constituting the ink jet recording cartridge C contains an ink absorbing material made of porous or fibrous material which is impregnated with the ink. Because of the provision of the ink absorbing material 51, the ink in the container 13 is not easy moved even upon impact or vibration applied to the cartridge, and therefore, the leakage of the ink or the adverse influence to the printing can be prevented. The ink is supplied to ejection nozzles through an integrating passage 1*g* at the bottom of the container 13. In accordance with the image signals supplied from the main assembly of the recording apparatus through a head connector 5, droplets of the ink are selectively ejected to the recording medium 30, by which an image is recorded.

A small cavity or chamber is formed in the container 13 substantially at the center of the ink containing space of the container 13. The small chamber is defined by partition walls 13*a*, 13*b*, 13*c* and 13*d*. The small chamber 20 is in communication with the ink absorbing material through the communication holes 20*a*, 20*b*, 20*c* and 20*d* provided between the partition walls 13*a*, 13*b*, 13*c* and 13*d*. Adjacent the center of the space constituting the small chamber 20, a cylindrical projection is provided so that an opening 22 for the air venting is disposed. By the air venting passage, the air is introduced into the container from the outside, following the reduction of the ink remaining in the ink container by the consumption of the ink, so that the ink can be supplied in good order to the recording head 1.

According to this embodiment, the small chamber 20 provides a space defined by the partition walls 13*a*, 13*b*, 13*c* and 13*d* in the container. The partition walls extend from one side walls constituting the container to the other side wall constituting it, at substantially the center of the container.

The internal dimensions of the ink container 13 of the ink jet recording head cartridge C are 50 mm in the length (in the direction of the ink ejection) 65 mm in the width (perpendicular to the ink ejection rejection) and 15 mm in the thickness (in the direction of the scanning movement of the carriage). The partition walls constitute a rectangular space having the length of 13 mm and width of 16 mm in the outside dimensions in the region 18.5 mm away from the top and bottom walls, and 24.5 mm away from the left and right walls.

The volume of the small chamber is 2 cc, and the volume of the ink container is 43 cc excluding the small chamber 20.

In this embodiment, the small chamber 20 has the above-described dimensions and volume. However, these figures are not limiting. The volume of the small chamber is 1/10–1/50 of the volume of the ink container, preferably 1/15–1/40 thereof, further preferably 1/20–1/30 thereof.

If the space occupied by the small chamber 20 is too large, the capacity of the ink container 13 becomes too small. If, on the contrary, it is too small, the small chamber 20 is easily filled with the ink woozed thereinto due to change in the ambient conditions, and it is liable that,the ink leaks out through the air venting passage 22. Therefore, the above-described ranges are preferable.

Figure 20A:
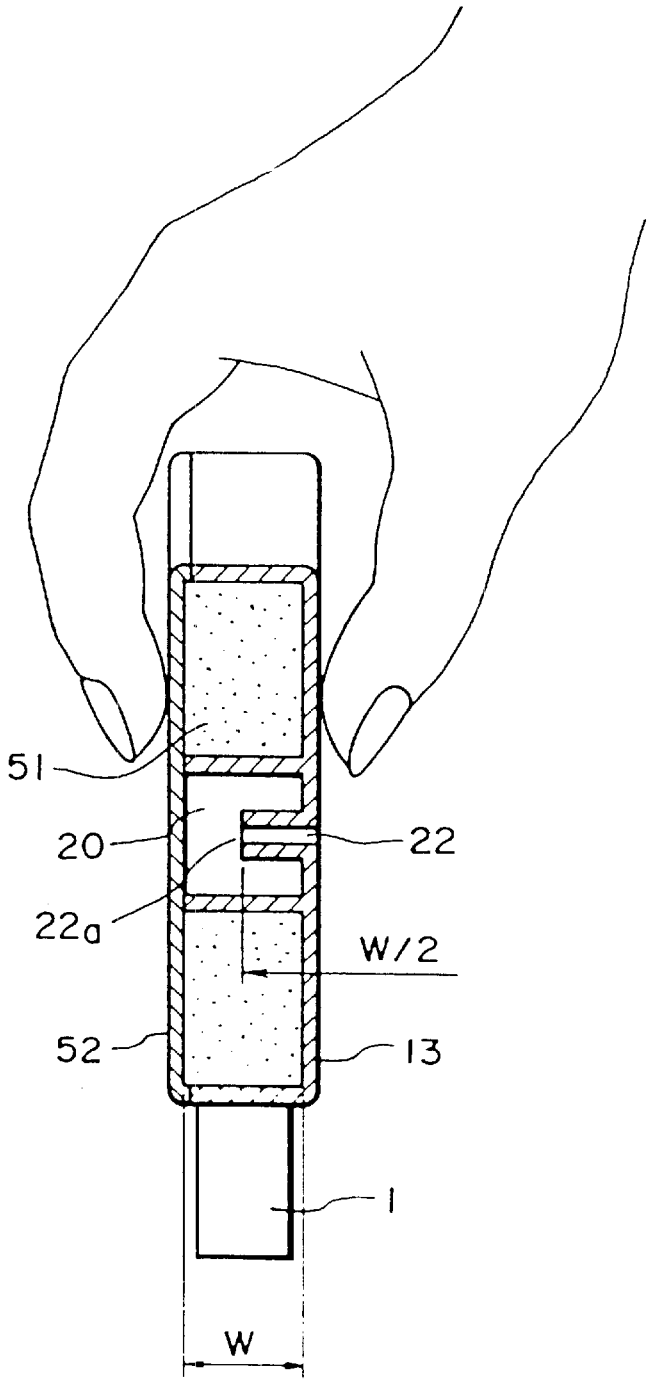
FIGS. 20A, 20B and 20C are sectional views of the air venting structure of the cartridge of FIG. 19.

The air venting passage 22 is constituted by a cylindrical projected member, which is disposed so that the air venting opening 22*a* is disposed substantially at the center in the space provided by the small chamber 20, as shown in FIG. 20A.

In this embodiment, the thickness of the ink container is 15 mm, and therefore, the end opening 22*a* of the air venting passage is formed at a position 7.5 mm away from the side wall. In this embodiment, the projecting member constituting the air venting passage 22 has a volume of 0.15 cc.

The volume of the projecting member is not limited to the above. It is 1/4–1/40 of the volume of the space of the small chamber 20, preferably 1/8–1/35, further preferably 1/10–1/30.

The diameter of the air venting passage 22 is 0.7 mm in this embodiment.

If this is too large, there is a liability that foreign matter is introduced from the outside to the inside of the container, and in addition, the ink evaporation speed is increased. From this standpoint, the diameter is preferably as small as possible, 0.1–2 mm for example.

Figure 20B:
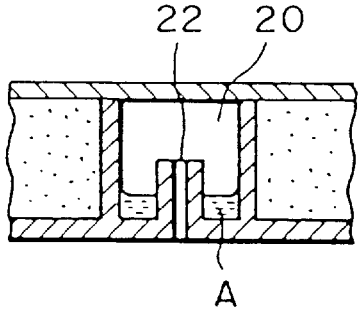
Figure 20C:
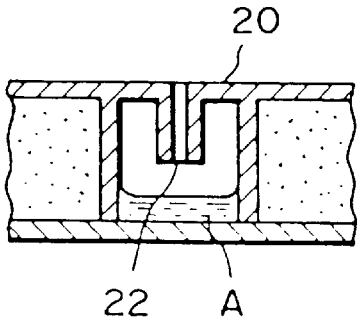

As described in the foregoing, the end opening 22*a* of the air venting passage 22 is disposed substantially at the center in the space provided by the small chamber 20, and therefore, even if the ink is woozed into the small chamber 20 due to the ambient conditions change or the like, as shown in the FIG. 20B or FIG. 20C, the ink is prevented from leaking out, irrespective of the position or pose of the ink jet recording head cartridge C.

FIG. 19 shows the state wherein the recording head is upside-down (as compared with the normal using state). With the elapse of time with this state, the ink gradually lowers in the absorbing material due to the temperature change or the like, so that an air layer and an ink layer are formed at the top and at the bottom, respectively. If the temperature increases after this state is established, the thermal expansion of the air in the air layer pushes a small quantity of ink into the small chamber through the communication openings 20*a*, 20*b*, 20*c* and 20*d*. The ink stagnates in the small chamber. However, since the end opening 22*a* of the air venting passage is substantially at the center of the small chamber, the ink does not leak out of the ink. When the temperature decreases, the ink A in the small chamber 20 returns into the absorbing material 51 through the communication openings 20*a*, 20*b*, 20*c* and 20*d*, and therefore, the ink is not accumulated in the small chamber 20. Therefore, even if the temperature repeatedly changes, the ink is prevented from leaking out of the container.

In FIG. 19 embodiment, the recording head 1 is left while being directed upwardly. However, the communication openings 20*a*, 20*b*, 20*c* and 20*d* are disposed at four positions, top, bottom, left and right positions of the small chamber, and therefore, irrespective of the orientations of the ink jet recording head cartridge, the ink is prevented from leaking out through the air venting passage 21, as shown in FIGS. 20B and 20C.

In addition, since the small chamber is disposed substantially at the center of the ink container, it is able to support the outer wall constituting the ink container. Therefore, even if the ink container 13 is strongly pressed by the operator upon mounting or dismounting of the ink jet recording head cartridge relative to the main assembly of the recording apparatus, the ink container 13 of the cartridge C is prevented from being deformed. It follows that the ink is prevented from being leaked out through the ejection outlet of the recording head or the air venting passage of the ink container, even if the container is in advertently pressed.

In addition, the expansion or shrinkage of the side walls of the ink container by the ambient temperature increase or decrease, can be prevented, and therefore, the leakage of the ink through the ejection outlet 3 or through the air venting passage 22 thereby can be prevented.

In this embodiment, the small chamber is generally rectangular, but it may be circular or spherical or another. The number of communication openings 22*a* will suffice if it is 2 or more.

Figure 21:
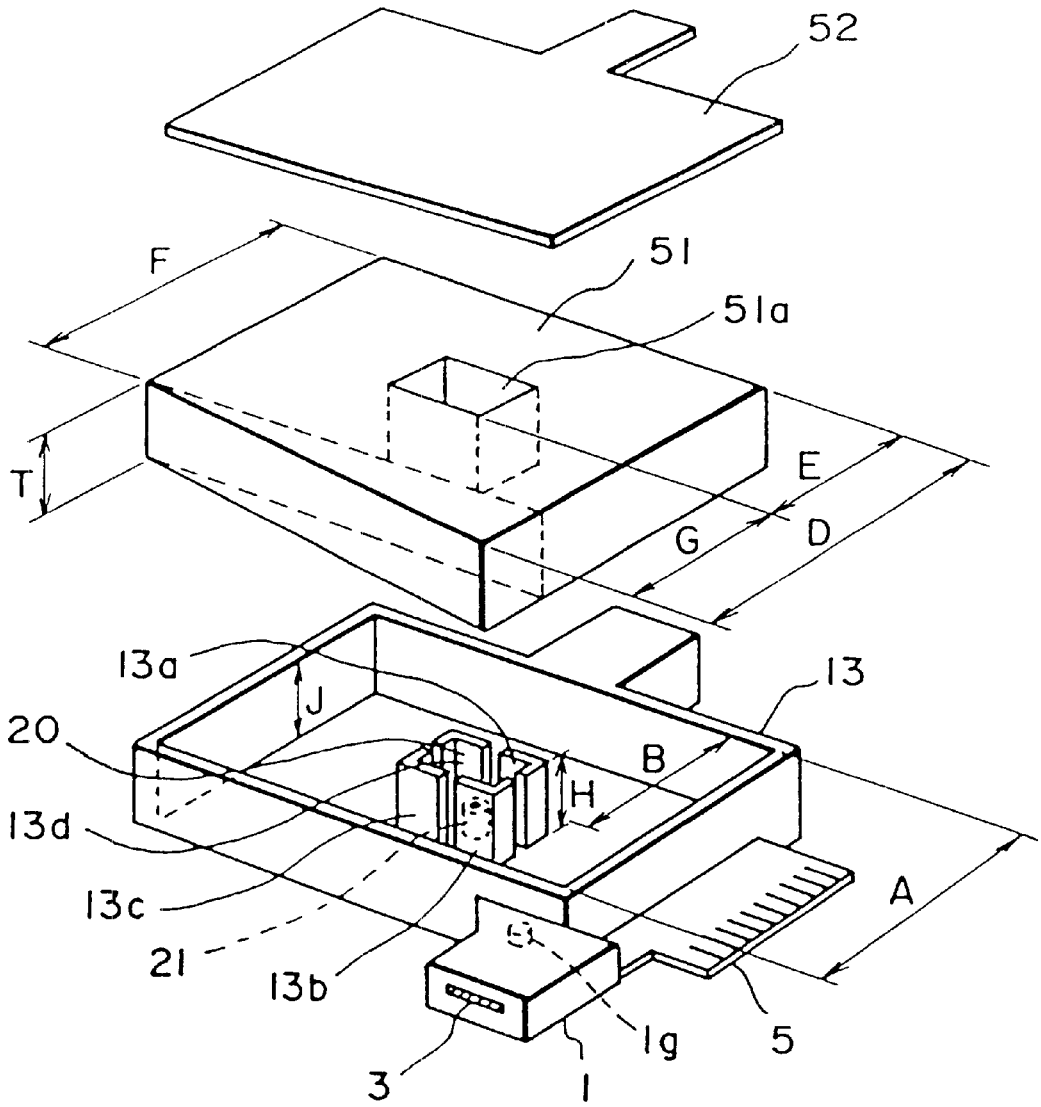
FIG. 21 is an exploded perspective view of the ink jet recording head cartridge according to a further embodiment of the present invention.

In this embodiment, the ink absorbing material has a configuration as shown in FIG. 21. As shown in FIG. 21, A is an inside dimension between the ink supply port 1*g* and the top surface of the container; B is an inside dimension between the top surface of the container and that side of the small chamber 20 projecting into the container which is nearer to the ink supply port 1*g*. In the ink absorbing material 51, D is a dimension of such a side of the ink absorbing material 51 which is contacted to the supply port 1*g*; E represent the position of a hole 51*a* engageable with the small chamber 20 of the container; F is a dimension of a side which does not have the ink supply port 1*g*; and T is a thickness of the ink absorbing material 51. In this embodiment, A=50 mm, B=31.5 mm, and a length measured in the direction perpendicular to A is 65 mm.

Here, the dimensions of the ink absorbing material 51 is:

| | |
|---|---|
| $D = k \times A$ | . . . (1) |
| $E = B + \alpha$ | . . . (2) |
| $F = A + \alpha$ | . . . (3) |
| $T = J + \alpha$ | . . . (4) |

Figure 1:
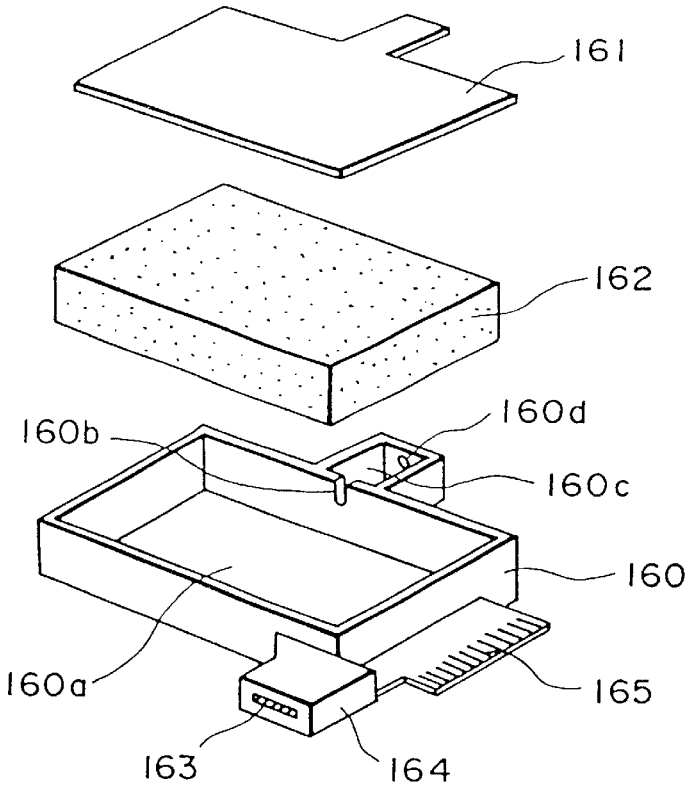
FIG. 1 is a perspective view of an ink jet recording head cartridge not using the present invention.
Figure 2:
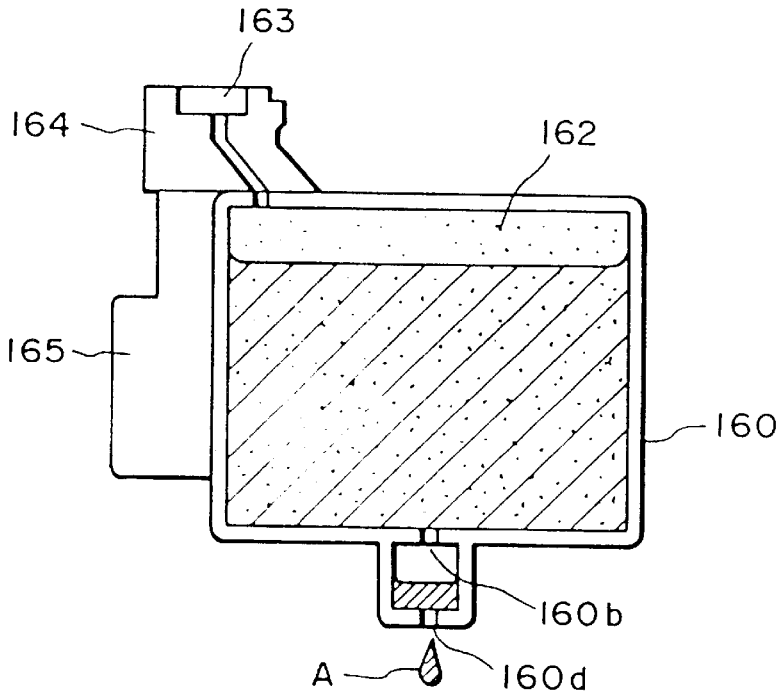
FIG. 2 is a sectional view of the cartridge of FIG. 1 when it is placed with its air venting hole at the bottom.
Figure 3:
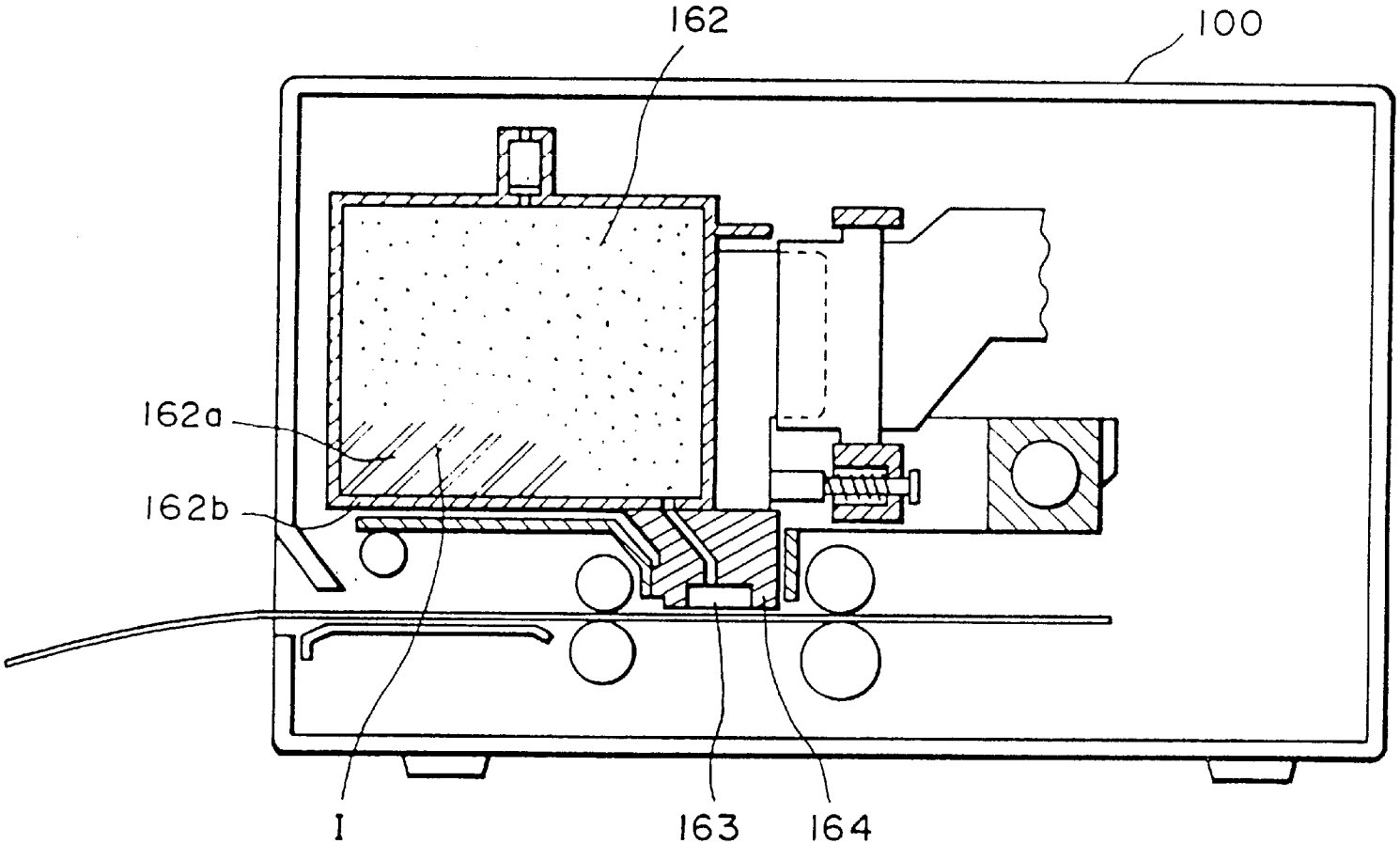
FIG. 3 is a sectional view of the cartridge of FIG. 1 set in the ink jet recording apparatus.

In the equation (1), "k" is preferably not more than 1. In this embodiment, it is 1.14. The value $\alpha$ is an interference relative to the internal dimension of the ink container. It is 1–2 mm in this embodiment. As will be understood, the ink absorbing material 51 is trapezoidal having a longer side at the ink supply port 1*g* side, by which when the ink absorbing material is set in the ink container, the density thereof is higher adjacent the ink supply port 1*g*. By doing so, good results were obtained. More particularly, the dimension G is larger than the dimension A–B of the container, so that when the ink absorbing material 51 is press-fitted into the container 13 upon assembling, the region G of the absorbing material 51 is pressed by the walls 13*a*, 13*b*, 13*c* and 13*d* of the small chamber 20, so that the ink absorbing material is particularly compressed adjacent the ink supply port, so that the density thereat is larger. With this structure, the region of the ink absorbing material 51 adjacent the ink supply port 1*g* is locally compressed by the engaging portion 13*b*, and therefore, the quantity of the ink there because small. For example, even if the ink remains in the manner shown in FIG. 3, the ink is concentrated to the high density side of the ink absorbing material 51, that is, toward the supply port 1*g* for the ink recording head, and therefore, the ink can be consumed properly.

In addition, in the commercial distribution system, even when the cartridge C is kept with the recording head 1 at the top for a substantial period of time, the ink is prevented to move to the air venting passage 52*b* side by the gravity because the density of the ink absorbing material is larger at the ink supply port 1*g* side. Thus, the neighborhood of the supply port 13*a* is always filled with the ink, so that the ink can be assuredly ejected upon use.

In this embodiment, the relative density difference of the ink absorbing material or the difference in the high density region and the low density region is influential.

In order to obtain good results, it is preferable that the density of the ink absorbing material in the high density region is-approximately 1.05–2 times that in the low density region, preferably 1.1–1.8 times, further preferably 1.2–1.5 times thereof.

In this embodiment, it will suffice if the portion of the ink absorbing material in the neighborhood of the ink supply port 1*g* for the recording head has the highest density when it is set in the ink container. Therefore, the use of the trapezoidal ink absorbing material having a longer side adjacent the ink supply port is not limiting. For example, the structure is such that the ink absorbing material is compressed adjacent the connector 5. Another structure satisfying the above is possible.

It is preferable that the walls 13*a*, 13*b*, 13*c* and 13*d* are disposed adjacent the center of the container 13, that the heights H thereof is equal to the depth J of the container, and that the walls 13*a*, 13*b*, 13*c* and 13*d* are fused with the cover of the container constituting one side wall of the container, since then even if the ink container 13 is pressed by the operator relatively strongly, the container 13 is deformed by the pressure, so that the ink is not easily leaked out through the ejection outlet 3 or through the air venting communication passage 22. In addition, the expansion or shrinkage of the side walls due to the temperature change can be prevented. Then, it is possible to provide a flat or thin ink jet recording cartridge. This is particularly advantageous when plural ink jet recording cartridges are used in one recording apparatus for the purpose of providing full-color print, since the entire size can be reduced.

In this embodiment, the internal walls 13*a*, 13*b*, 13*c* and 13*d* constitute a box for providing air venting. However, it is a possible alternative that the air venting passage 22 is formed in the manner shown in FIGS. 6 and 7, and columnar boss 13*h*, a linear rib 13*i*, or a cross rib 13*j* or the like may be used with the same advantageous effect (A and B show the corresponding parts in FIG. 21).

In this embodiment, only one engaging portion (walls) at one position substantially at the center, but plural of such portions may be provided if the flow of the ink is not impeded.

Figure 22A:
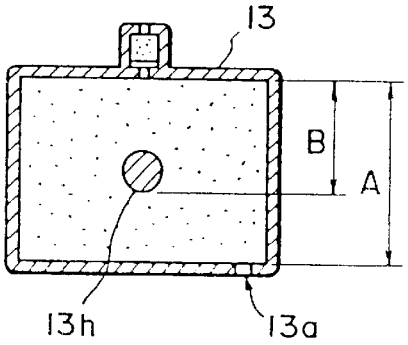
FIGS. 22A, 22B, 22C, 22D and 22E are sectional views of ink containers of ink jet recording head cartridges according to the present invention.
Figure 22D:
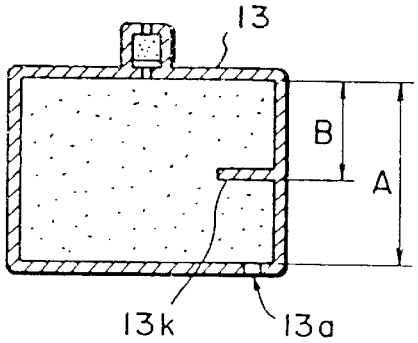
Figure 22B:
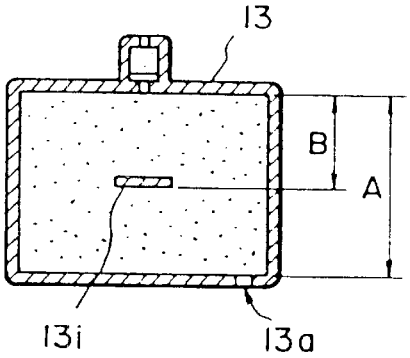

As shown in FIG. 22D, a rib 13*k* may be projected from an internal side surface of the container right above the ink supply port 13*a*.

Figure 22E:
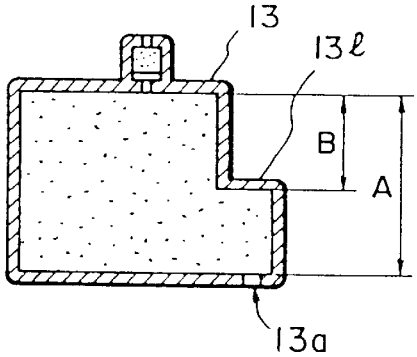
Figure 22C:
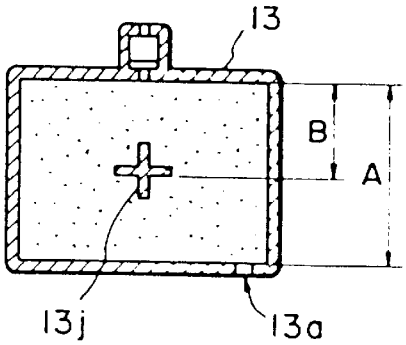

FIG. 22E shows a further alternative, wherein a part of the ink container is projected outwardly, and the wall portion 13*l* of the projection functions as a connection between the opposite walls, and the ink absorbing material is compressed between the wall 13*l* and the supply port 13*a* (A–B). The same advantageous effects can be provided.

In this embodiment, the portion connecting the opposite walls are integrally formed with the main body of the tank, but it is a possible alternative that it is integral with the cover for the container, or it may be constituted by connecting ribs extending from the main body and the cover. As a further alternative, it may be separate member which is fixed to the opposite walls.

As described in the foregoing, the ink container of the ink jet head cartridge has, adjacent the center of the ink container, a small chamber communicating with the ink absorbing material and an air venting communication passage in the form of a cylinder projecting into the inside of the tank. Therefore, even if the ink jet recording cartridge is left alone, the ink leakage can be effectively prevented.

By disposing the small chamber adjacent the center of the ink container, the mechanical strength of the side walls of the ink container against deformation can be increased, and therefore, the ink cartridge has a sufficient mechanical strength even if it is thin configuration.

As described in the foregoing also, a connecting portion is provided inside the ink, and the ink absorbing material has a dimension smaller than the distance between the connecting portion and the ink supply port for the recording head is packed into between the connecting portion and the supply port. Therefore, even if the remaining quantity of the ink becomes small, the ink flows to the supply port side, that is, the high density side of the absorbing material, and therefore, the printing operation is not obstructed.

For the similar reason, even if the ink recording head is left with the head portion at the top in the commercial distribution system or the like, the initial improper printing attributable to the lack of the ink adjacent the supply port to the recording head by the gravity, can be prevented.

If the connecting portion is disposed substantially at the center of the ink container, and the connecting portion has the height which is the same as the internal clearance of the container, and the opposite walls are used thereby. Then, the ink jet recording head cartridge has a sufficient strength against the external force or the tendency of deformation due to the ambient temperature change.

The present invention is particularly suitably usable in a bubble jet recording head and recording apparatus developed by Canon Kabushiki Kaisha, Japan. This is because, the high density of the picture element, and the high resolution of the recording are possible.

The typical structure and the operational principle of preferably the one disclosed in U.S. Pat. Nos. 4,723,129 and 4,740,796. The principle is applicable to a so-called on-demand type recording system and a continuous type recording system particularly however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provide by the electrothermal transducer to produce film boiling on the heating portion of the recording head, whereby a bubble can be formed in the liquid (ink) corresponding to each of the driving signals. By the development and collapse of the the bubble, the liquid (ink) is ejected through an ejection outlet to produce at least one droplet. The driving signal is preferably in the form of a pulse, because the development and collapse of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion in addition to the structure of the combination of the ejection outlet, liquid passage and the electrothermal transducer as disclosed in the above-mentioned patents. In addition, the present invention is applicable to the structure disclosed in Japanese Laid-Open Patent Application Publication No. 123670/1984 wherein a common slit is used as the ejection outlet for plural electrothermal transducers, and to the structure disclosed in Japanese Laid-Open Patent Application No. 138461/1984 wherein an opening for absorbing pressure wave of the thermal energy is formed corresponding to the ejecting portion. This is because, the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and a plural recording head combined to cover the entire width.

In addition, the present invention is applicable to a serial type recording head wherein the recording head is fixed on the main assembly, to a replaceable chip type recording head which is connected electrically with the main apparatus and can be supplied with the ink by being mounted in the main assembly, or to a cartridge type recording head having an integral ink container.

The provision of the recovery means and the auxiliary means for the preliminary operation are preferable, because they can further stabilize the effect of the present invention. As for such means, there are capping means for the recording head, cleaning means therefor, pressing or sucking means, preliminary heating means by the ejection electrothermal transducer or by a combination of the ejection electrothermal transducer and additional heating element and means for preliminary ejection not for the recording operation, which can stabilize the recording operation.

As regards the kinds of the recording head mountable, it may be a single corresponding to a single color ink, or may be plural corresponding to the plurality of ink materials having different recording color or density. The present invention is effectively applicable to an apparatus having at least one of a monochromatic mode mainly with black and a multi-color with different color ink materials and a full-color mode by the mixture of the colors which may be an integrally formed recording unit or a combination of plural recording heads.

Furthermore, in the foregoing embodiment, the ink has been liquid. It may be, however, an ink material solidified at the room temperature or below and liquefied at the room temperature. Since in the ink jet recording system, the ink is controlled within the temperature not less than 30° C. and not more than 70° C. to stabilize the viscosity of the ink to provide the stabilized ejection, in usual recording apparatus of this type, the ink is such that it is liquid within the temperature range when the recording signal is applied. In addition, the temperature rise due to the thermal energy is positively prevented by consuming it for the state change of the ink from the solid state to the liquid state, or the ink material is solidified when it is left is used to prevent the evaporation of the ink. In either of the cases, the application of the recording signal producing thermal energy, the ink may be liquefied, and the liquefied ink may be ejected. The ink may start to be solidified at the time when it reaches the recording material. The present invention is applicable to such an ink material as is liquefied by the application of the thermal energy. Such an ink material may be retained as a liquid or solid material on through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink jet recording apparatus may be used as an output terminal of an information processing apparatus such as computer or the like, a copying apparatus combined with an image reader or the like, or a facsimile machine having information sending and receiving functions.

While the invention has been described with reference to the structures disclosed herein, it is not confined to the details set forth and this application is intended to cover such modifications or changes as may come within the purposes of the improvements or the scope of the following claims.

What is claimed is:

1. An ink jet head cartridge, comprising:

a recording head for ejecting ink;

an ink container for containing the ink to be supplied to said recording head;

an ink absorbing material made of porous or fibrous material in said ink container, wherein an inside of said ink container is communicated with ambience to permit supply of the ink from said ink container to said recording head, wherein said absorbing material has a higher density adjacent ink supply port for supporting the ink from said container to said recording head, and has a decreasing density away from the supply port; and a projection for providing the portion of the high density of said ink absorbing material by engagement with said ink absorbing material.

2. A cartridge according to claim 1, wherein said ink absorbing material is of trapezoidal configuration having a longer side adjacent the ink supply port, when it is not set in said ink container, and by placing said ink absorbing material between said projection and a wall at the ink supply port side, the high density can be provided, and wherein said projection is effective to provide two flows of the ink to the ink supply port.

3. A cartridge according to claim 1, wherein the high density is 1.05–2 times a density of the other part.

4. A cartridge according to claim 1, wherein said recording head has an ink ejection element using thermal energy.

5. An ink jet recording apparatus, comprising:

an ink jet head cartridge, including;

a recording head for ejecting ink;

an ink container for containing the ink to be supplied to said recording head;

an ink absorbing material made of porous or fibrous material in said ink container, wherein an inside of said ink container is communicated with ambience to permit supply of the ink from said ink container to said recording head, wherein said absorbing material has a higher density adjacent ink supply port for supporting the ink from said container to said recording head, and has a decreasing density away from the supply port;

a projection for providing the portion of the high density of said ink absorbing material by engagement with said ink absorbing material;

said apparatus further comprising a carriage for mounting said cartridge.

* * * * *

UNITED STATES PATENT AND TRADEMARK OFFICE

CERTIFICATE OF CORRECTION

PATENT NO. : 6,609,790 B2
DATED : August 26, 2003
INVENTOR(S) : Mitsuru Kurataet al.

It is certified that error appears in the above-identified patent and that said Letters Patent is hereby corrected as shown below:

Title page,
Item [62], "Related U.S. Application Data", add -- This application is related to Application No. 08/279,079, filed July 22, 1994, now U.S. Patent 5,557,310. --

Column 1,
Line 32, "with" should read -- with a --;
Line 35, "a trouble leading" should read -- trouble leading to --; and
Line 67, "160," should read -- 160, and --.

Column 2,
Line 6, "droplet" should read -- droplets --;
Line 28, "water" should read -- water-based --; and
Line 41, "with" should read -- in --.

Column 3,
Line 4, "is" should be deleted.

Column 6,
Line 34, "has a" should read -- includes the --;
Line 37, "not" should read --(not --;
Line 38, "shown" should read -- shown) --; and
Line 49, "lishes" should read -- lish --.

Column 7,
Line 2, "easy" should read -- ease of --;
Line 14, "woozing" should read -- oozing --;
Line 32, "detection" should read -- direction --;
Line 49, "13a)." should read -- 14a). --;
Line 55, "passage" should read -- passage length, --;
Line 56, "larger" should read -- longer --; and
Line 63, "them," should read -- the above points, --.

Column 8,
Line 5, "cranked" should read -- crooked or labyrinthine --;
Line 23, "20b" should read -- 21b --; and
Line 56, "woozed" should read -- oozed --.

UNITED STATES PATENT AND TRADEMARK OFFICE

CERTIFICATE OF CORRECTION

PATENT NO. : 6,609,790 B2
DATED : August 26, 2003
INVENTOR(S) : Mitsuru Kurata et al.

It is certified that error appears in the above-identified patent and that said Letters Patent is hereby corrected as shown below:

Column 9,
Line 8, “woozed” should read -- oozed --;
Line 22, “property” should read -- properly --;
Lines 26 and 29, “member” should read -- members --;
Line 40, “apparatus the” should read -- apparatus. The --, and “has” should read -- includes --;
Line 45, “not shown,” should read -- (not shown), --; and
Line 64, “head” should read -- head cartridge”.

Column 10,
Line 12, “approach” should read -- approaches --;
Line 24, “red” should read -- led --;
Lines 27, 31 and 38, “woozed” should read -- oozed --.

Column 11,
Line 46, “be” should read -- also be --; and
Line 47, “The” should read -- The type of --.

Column 12,
Line 57, “is” should read -- is in --; and
Line 65, “a number print” should read -- the number of prints --.

Column 13,
Line 5, “of” should read -- of an --;
Line 13, “the ink container” should be deleted.
Line 20, “cube” should read -- tube --;
Line 38, “of” should read -- of a --;
Line 48, “the reduction of” should read -- a reduction in --; and
Line 55, “easy” should read -- easily --.

Column 14,
Line 13, “one” should read -- one of the --;
Line 14, “other” should read -- opposite --;
Line 15, “it,” should read -- the container, --;
Lines 36 and 63, “woozed” should read -- oozed --.

Column 15,
Line 14, “of the ink.” should read -- through the passage. --.
Line 21, “In” should read -- In the --;
Line 49, “another” should read -- another shape --; and
Line 61, “represent” should read -- represents --.

UNITED STATES PATENT AND TRADEMARK OFFICE

CERTIFICATE OF CORRECTION

PATENT NO. : 6,609,790 B2
DATED : August 26, 2003
INVENTOR(S) : Mitsuru Kurata et al.

It is certified that error appears in the above-identified patent and that said Letters Patent is hereby corrected as shown below:

Column 16,
Line 9, “more” should read -- less --;
Line 27, “because” should read -- becomes --;
Line 60, “is” should read -- are --;
Line 64, “is” should read -- is not --; and
Line 67, “22.” should read -- 21. --.

Column 17,
Line 5, “print,” should read -- printing, --;
Line 9, “22” should read -- 21 --;
Line 14, “at” should read -- is provided at --;
Line 31, “be” should read -- be a --;
Line 44, “is” should read -- is in a --;
Line 46, “ink,” should read -- ink container --;
Line 48, “is” should read -- and is --;
Line 49, “into” should be deleted;
Line 57, “to” should read -- of --;
Line 58, “by the” should read -- due to --; and
Line 62, “thereby. Then,” should read -- Thereby, --.

Column 18,
Line 2, “element,” should read -- elements, --;
Line 4, “principle of” should be deleted;
Line 5, “preferably the one” should read -- principles are preferably those --;
Line 8, “system particularly” should read -- system. Particularly, --;
Line 14, “provide” should read -- provided --;
Line 36, “Publication” should be deleted;
Line 41, “wave” should read -- waves --;
Line 49, “and a” should read -- or --;
Line 50, “head” should read -- heads --; and
Line 62, “sucking” should read -- suction --.

UNITED STATES PATENT AND TRADEMARK OFFICE

CERTIFICATE OF CORRECTION

PATENT NO. : 6,609,790 B2
DATED : August 26, 2003
INVENTOR(S) : Mitsuru Kurata et al.

It is certified that error appears in the above-identified patent and that said Letters Patent is hereby corrected as shown below:

Column 19,
Line 1, “head” should read -- heads --;
Line 2, “single” should read -- single head --;
Line 3, “plural” should read -- plural heads --;
Line 4, “color or density.” should read -- colors or densities. --;
Line 7, “with” should read -- mode with --;
Line 18, “in” should read -- in a --;
Line 22, “it” should read -- the energy --;
Line 24, “or the ink” should read -- or the use of ink --;
Line 25, “material” should read -- material that --, and “left is used to prevent” should read -- ejected prevents --; and
Line 31, “as” should read -- as it --.

Signed and Sealed this

Thirty-first Day of August, 2004

JON W. DUDAS
*Director of the United States Patent and Trademark Office*